US006047157A

United States Patent [19]

Tatematsu et al.

[11] Patent Number: 6,047,157

[45] Date of Patent: Apr. 4, 2000

[54] IMAGE FORMATION APPARATUS, OIL APPLICATION ROLLER UNIT AND FIXING DEVICE THEREFOR

[75] Inventors: Hideki Tatematsu, Ashiya; Keizou Takeuchi, Hirakata; Akinori Toyoda, Katano, all of Japan

[73] Assignee: Matsushita Electric Industrial Co., Ltd., Osaka-fu, Japan

[21] Appl. No.: 09/325,216

[22] Filed: Jun. 3, 1999

[30] Foreign Application Priority Data

Jun. 5, 1998 [JP] Japan ..... 10-157596
May 25, 1999 [JP] Japan ..... 11-145504

[51] Int. Cl.[7] ..... G03G 15/20

[52] U.S. Cl. ..... 399/325; 399/324; 118/DIG. 1

[58] Field of Search ..... 399/324, 325; 430/124, 126; 492/17, 18, 46; 118/DIG. 1, DIG. 14, DIG. 15, 60, 264, 266, 268, 202, 161; 184/17, 20, 15.1; 428/321.1

[56] References Cited

U.S. PATENT DOCUMENTS 4,757,347 7/1988 Tamaoki et al. ..... 399/325
5,534,986 7/1996 Irro et al. ..... 399/325
5,732,317 3/1998 Orchard, II et al. ..... 399/325
5,853,832 12/1998 Ishikawa ..... 399/325 X
5,902,653 5/1999 Miyahara et al. ..... 399/325 X

FOREIGN PATENT DOCUMENTS 60-115975 6/1985 Japan .
5-123623 5/1993 Japan .

*Primary Examiner*—Matthew S. Smith
*Attorney, Agent, or Firm*—Akin, Gump, Strauss, Hauer & Feld, L.L.P.

[57] ABSTRACT

An oil application roller unit including a holder having at least a shaft or bearings, an oil application roller rotatably supported by the holder, and an oil leakage prevention film closely wound around the oil application roller to pack the roller and capable of being pulled out. By pulling the oil leakage prevention film while the oil application roller remains installed in the holder, the oil application roller is rotated, and the oil leakage prevention film can be removed. Since the user is not required to make contact with the oil application roller at the time of unpacking, the hands of the user are not stained. Unpacking can thus be attained safely.

28 Claims, 18 Drawing Sheets

IMAGE FORMATION APPARATUS, OIL APPLICATION ROLLER UNIT AND FIXING DEVICE THEREFOR

BACKGROUND OF THE INVENTION

Field of the Invention

The present invention relates to a roller unit for applying release oil to the heating roller of a fixing device for use in monochrome and color printers, copiers, facsimiles, etc., and also relates to an image formation apparatus incorporating the roller unit.

Color toner for use in image formation apparatuses, such as a copier, printer and the like, for forming full-color images by an electrophotographic image formation process is required to have superior transmittancy at the time when the toner is fixed to a recording medium. Color toner including a binder resin, being fused quickly and having a low viscosity at the time of fusion is used to attain this superior transmittancy. A method of fixing this color toner by using a fixing device having a heating roller of silicon rubber has been employed conventionally. In the above-mentioned fixing device, the surface of the heating roller is formed of silicon rubber. Furthermore, the fixing device uses color toner including a binder resin being fused quickly and having a low viscosity at the time of fusion. For these reasons, hot offset, a phenomenon wherein fused color toner is attached to the surface of the heating roller, is apt to occur. To prevent hot offset, a release agent, such as silicone oil, having a high affinity for silicon rubber and being relatively inexpensive, is applied abundantly to the surface of the heating roller.

A release ingredient included in the toner itself has recently been used to prevent hot offset. In this case, it is still necessary to apply a release agent, although the application amount of the release agent is small.

Various roller-shaped members have been proposed as a member for applying oil to the fixing device or the like. As an example of this type, Japanese Patent Publication No. Hei 1-60144 discloses a roller-shaped member comprising a pipe with a plurality of pores disposed in the external circumferential portion thereof, release oil provided at the central portion of the pipe, and heat-resistant felt made of Nomex or the like wound around the external circumference of the pipe. Japanese Laid-open Utility Model Application No. Sho 61-104469 discloses a roller-shaped member covered with a porous material, such as paper, on which heat-resistant felt is wound to control leak amount of oil and diffuse oil in the axial direction of the roller, and uniformly apply oil to its entire surface. Furthermore, Japanese Laid-Open Patent Application No. Hei 5-123623 discloses a member having a silicon sponge layer or the like used as an intermediate layer to provide elasticity. Moreover, Japanese Laid-open Patent Application No. Sho 61-104469 discloses a roller-shaped member comprising a heat-resistant porous material instead of the heat-resistant felt.

In these conventional arts oil exudes from the felt or porous material on the surface, and is directly applied and transferred to the fixing roll. Therefore, it is difficult to control the application amount of the oil. To make the application amount of oil controllable, Japanese Laid-open Patent Application No. Sho 61-183679 discloses a member wherein a heat-resistant microporous film layer is provided on the surface of a heat-resistant felt layer or a porous material. Japanese Laid-open Patent Application No. Sho 62-178992 discloses a member wherein a composite film filled with a mixture of silicone rubber and oil is used as an oil permeation control layer.

In a color electrophotographic apparatus, its photosensitive member is charged by corona discharge using a charger. Light signals are then cast to the photosensitive member to form electrostatic latent images for all colors. Next, toner for a first color, such as yellow toner, is used for development to obtain a visible image. A transfer material charged in the polarity opposite to that of the yellow toner is made contact with the photosensitive member to transfer the yellow toner image formed on the photosensitive member. Toner remaining after the transfer is removed by cleaning from the photosensitive member, and the photosensitive member is electrically erased. This completes the development and transfer of the first color toner.

The same operation as that for the yellow toner is carried out repeatedly for magenta toner and cyan toner. The toner images of these colors are superimposed on the transfer material to form a color image. The toner image obtained by the superimposing operation is transferred to paper charged in the polarity opposite to that of the toner, and fixed, thereby ending copying operation.

The transfer drum method is generally used as a color image formation method. In the transfer drum method, color toner images are formed in sequence on a single photosensitive member. A transfer material entrained about a transfer drum is rotated so as to be opposed repeatedly, to the photosensitive member, whereby the color toner images formed in sequence are superimposed and transferred. Furthermore, the continuous superimposing method is also used in general, wherein a plurality of image formation units are arranged in a line, and a transfer material is fed via belts and is passed through the image formation units so that color toner images are transferred in sequence.

A color image formation apparatus using the above-mentioned transfer drum method is disclosed in Japanese Laid-open Patent Application No. Hei 1-252982.

On the other hand, a conventional example of a color image formation apparatus using the continuous transfer method is disclosed in Japanese Laid-open Patent Application No. Hei 1-250970. This conventional example is provided with four image formation stations each comprising a photosensitive member, optical scanning means and the like to carry out four-color image formation. Paper fed via belts is passed through the lower portion of each photosensitive member, whereby color toner images are superimposed.

Another method of forming a color image by superimposing different color toner images on a transfer material is disclosed in Japanese Laid-open Patent Application No. Hei 2-212867. In this method, color toner images formed in sequence on the photosensitive member are superimposed once on an intermediate transfer material, and the toner images on the intermediate transfer material are transferred to paper all together.

However, in order to attain stable control of the permeation amount of oil at the oil permeation control layer in these conventional examples, the amount of oil supplied to the oil permeation control layer must be controlled constant. Furthermore, the oil holding layer thereof is desired to have a two-layer structure comprising an oil supply layer and an oil diffusion layer to accomplish stable oil application for a long term. In this case, a difference in osmotic pressure is required between the two layers so that oil can move. In addition, the porosity (the ratio of the volume of pores to the total volume) of the oil supply layer is required to be higher than the porosity of the oil diffusion layer. The porosity of the oil supply layer is also required to be high so that the oil application roller can have a long service life. However, if the porosity of the oil supply layer is high, its oil holding capability lowers, thereby being apt to cause oil leakage. Moreover, if an oil tank is used as the oil supply layer, the risk of oil leakage may become higher.

Furthermore, in the event that release oil makes contact with the microporous film or the composite film of the oil permeation control layer, the pores in the microporous film are closed by oil. If a large amount of gas is generated abruptly, it is difficult for the gas to pass through the pores. If the gas is forcibly passed through with a pressure, then a considerable pressure for example, of about 50 kgf/cm$^2$ is required. For this reason, higher pressure is required if the diameter of the pores in the microporous film is made smaller to decrease the permeation amount of oil. In addition, in the case of the above-mentioned composite film, it is difficult to allow gas to pass through without damaging the film.

Furthermore, a steam pressure rises because of moisture absorbed in oil and the porous material depending on the change in the temperature of the fixing device. Moreover, a pressure also rises in the oil supply layer when the oil itself expands owing to heat. Because of these pressure rise, the oil permeation control layer undergoes an excessive pressure. As a result, oil is liable to burst out, thereby increasing the first application amount of oil. In some cases, trouble may be caused, for example, the oil permeation control layer may be damaged or may swell like a balloon.

To prevent this trouble, vent holes for allowing the pressure inside the oil application roller to release are provided at the end portions of the oil application roller. In particular, the vent holes should be provided in the axial direction of the roller. In this case, however, oil inevitably leaks from the vent holes when the oil application roller is tilted during transportation or storage.

If the oil application roller is sealed completely by vacuum packing or the like to prevent oil leakage during transformation, oil leakage will not be caused. However, it is difficult to seal the oil application roller together with its housing unit. Although it is possible to use a method wherein only the oil application roller is packed so as to be sealed completely and then unpacked before use, ease of handling by the user is impaired in this case.

Furthermore, in the case of sealing the roller completely by winding a film or the like around the roller, if an adhesive is applied to the circumference of the film and bonded to the roller to attain tight sealing, a large force is required to remove the film at the time of unpacking. If the film is not removed carefully and properly, the film may be torn. In addition, if the adhesive remains on the oil application roller, nonuniform oil application may be caused.

BRIEF SUMMARY OF THE INVENTION

An object of the present invention is to provide an oil application roller which is safely unpacked, without dismounting the oil application roller from a holder, that is, in the combined condition of the holder and the roller without causing the hands of the user to be stained with oil.

Another object of the present invention is to provide an oil application roller of which oil leakage from its end portions is prevented even when the shaft of the oil application roller is placed in an upright condition during storage, and also of which oil leakage running along the roller is prevented even when the roller is turned upside down.

A still another object of the present invention is to provide an oil application roller capable of allowing an oil leakage prevention film to be removed, without damaging the oil application roller, and also capable of being positioned accurately with respect to the holder.

A yet still another object of the present invention is to provide an oil application roller of which oil leakage from vent holes is prevented during storage, and capable of allowing the vent holes to be opened at the time of unpacking before use. This prevents the problem of forgetting to remove a plug used to close a vent hole provided in a conventional roller.

A further object of the present invention is to provide an oil application roller not causing oil leakage from gas release holes during storage, capable of allowing the gas release holes to be opened by removing the oil leakage prevention film before use so that the gas release holes can be used as vent holes.

An oil application roller unit of the present invention comprises, an oil application roller rotatably supported by a holder, and an oil leakage prevention film closely wound around the oil application roller to pack the roller and capable of being pulled out.

Since the oil leakage prevention film is closely wound around the oil application roller, no oil leakage is caused. For removing the oil leakage prevention film, the film is pulled in the state that the oil application roller remains installed in the holder. The oil leakage prevention film can be removed while the oil application roller is rotated by pulling the oil leakage prevention film. Since the hands of the user do not make contact with the oil application roller at the time of unpacking, the hands are not stained with oil. Safe unpacking can thus be attained.

An oil application roller unit in other aspect of the present invention comprises an oil application roller, seal rings provided at both ends of the oil application roller, and an oil leakage prevention film which is closely wound around the oil application roller to pack the roller and having end portions liquid-tightly secured to the seal rings.

Since both ends of the oil application roller are sealed by the liquid-tight seal rings, oil leak does not occur at both ends. Oil leakage can thus be prevented even when the oil application roll is placed in an upright condition during storage. Even when the roller is turned upside down, oil is prevented from leaking along the roller.

An oil application roller unit of the present invention comprises an oil application roller rotatably supported by a holder. The oil application roller is provided with seal rings on both ends thereof, and also provided with an oil leakage prevention film. This film is closely wound around the oil application roller to pack the roller, has end portions liquid-tightly secured to the seal rings, and can be pulled out.

Since both end portions of the oil application roller are sealed by the seal rings, oil leak does not occur at both ends. By pulling the oil leakage prevention film in the state that the oil application roller has been installed in the holder, the film can be removed while the oil application roller is rotated. With this structure, the oil leakage prevention film can be removed without damaging the oil application roller. In addition, the oil application roller can be positioned accurately with respect to the holder.

An oil application roller unit in other aspect of the present invention comprises an oil application roller having vent holes at end portions thereof, and an oil leakage prevention film closely wound around the oil application roller to pack the roller. The vent holes are closed with the oil leakage prevention film. With this structure, oil leakage does not occur during storage. The vent holes can be opened at the time of unpacking before use. This prevents the problem of forgetting to remove a plug used to close a vent hole provided in a conventional roller.

An oil application roller unit in other aspect of the present invention comprises an oil application roller having vent holes at end portions thereof, an oil leakage prevention film closely wound around the oil application roller to pack the roller, and seal rings provided at both ends of the oil application roller. The seal ring is provided with gas release holes communicating with the interior of the oil application roller, and the gas release holes are closed by the end portions of the oil leakage prevention film. With this structure, oil leakage does not occur at the gas release holes. By removing the oil leakage prevention film before use, the gas release holes are opened, and gas generating inside the roller during use is discharged.

An application roller unit in other aspect of the present invention is characterized in that an adhesive for securing the oil leakage prevention film is applied to a continuous range at least from one end portion to the other end portion of the oil application roller. The adhesive applied in the continuous range prevents oil leakage.

An oil application roller unit in other aspect of the present invention is characterized in that, among the application portions of the adhesive applied to the oil leakage prevention film, the application length of the adhesive applied in the direction perpendicular to the pulling direction of the oil leakage prevention film is ⅔ or less of the axial length of the oil application roller. By shortening the application length of the adhesive applied in the direction perpendicular to the pulling direction of the oil leakage prevention film than the axial length of the oil application roller, the oil leakage prevention film can be removed by a small pulling force.

An oil application roller unit in other aspect of the present invention comprises an oil application roller rotatably supported by a holder and having vent holes at end portions thereof. The oil application roller is provided, on both ends thereof, with seal rings having gas release holes in the side surfaces thereof and communicating with the vent holes, and a heat-shrinkable oil leakage prevention film. This film is closely wound around the oil application roller to pack the roller. The gas release holes are closed by the end portions of the heat-shrinkable oil leakage prevention film.

By providing the gas release holes in the side surfaces of the seal rings and by liquid-tightly covering the gas release holes with the heat-shrinkable oil leakage prevention film used as a packing material, the gas release holes can be tightly sealed by the heat-shrinkable oil leakage prevention film easily, without using any adhesive.

DETAILED DESCRIPTION OF THE INVENTION

Figure 1:
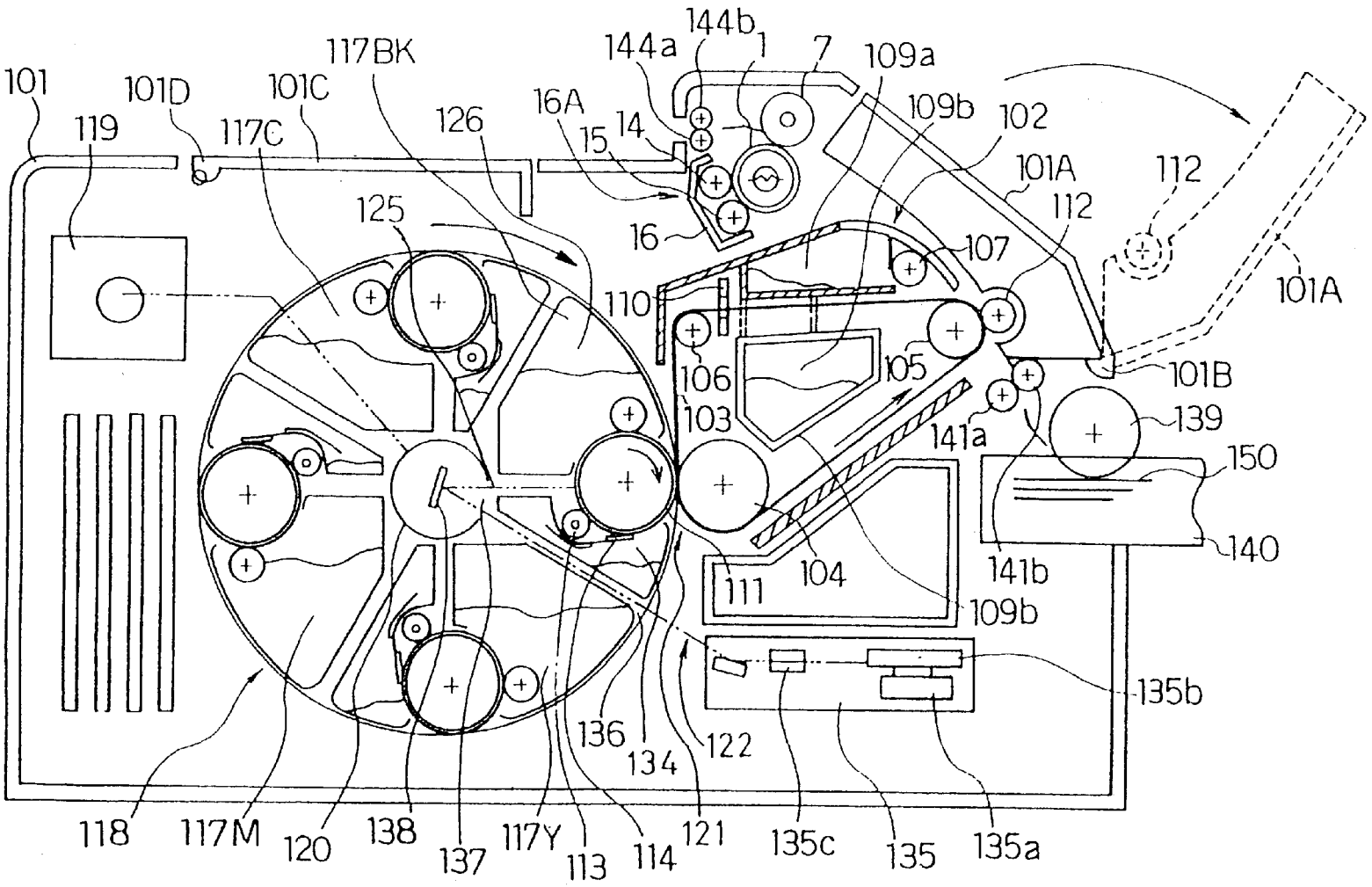
FIG. 1 is a sectional side view showing an image formation apparatus in accordance with a first embodiment of the present invention.

Embodiments in accordance with the present invention will be described below in detail.

The oil application roller unit of the present invention comprises an oil application roller rotatably supported by a holder and an oil leakage prevention film closely wound around the oil application roller to pack the roller and capable of being pulled out.

By pulling the oil leakage prevention film in the state that the oil application roller is installed in the holder, the film can be removed while the oil application roller is rotated.

When an oil application roller is stored in the state that its shaft is placed in an upright condition, oil leaks at the lower end thereof or exudes along the shaft. Therefore, the oil application roller should desirably be sealed tightly during storage to prevent oil leakage. In the case of the conventional tight sealing method, such as the vacuum-packing method, it is difficult to tightly seal the oil application roller in the state that the roller is installed in the holder in a unit condition. For this reason, only the oil application roller removed from the holder is tightly sealed and packed. As a result, only the oil application roller, among the various components of the unit, must be replaced by the user. When the oil application roller is replaced, the hands of the user may be stained with oil, or the surface layer of the oil application roller may be damaged. This replacement is thus undesirable and troublesome maintenance operation.

The oil application roller of the present invention is packed in a unit condition wherein the roller is built in the holder. Therefore, the oil application roller can be handled in the state that the roller is in the unit condition wherein the roller is built in the holder.

In other words, after unpacking, by pulling the end of the oil leakage prevention film closely wound around the oil application roller, the oil application roller is rotated inside the holder. It is therefore possible to remove the oil leakage prevention film without making contact with the oil application roller. As a result, maintenance can be accomplished by easy operation. Since the user is not required to make contact with the oil application roller at the time of unpacking and installing the holder, the hands of the user are not stained. Unpacking can thus be attained safely.

The oil application roller unit of the present invention is provided with seal rings at the end portions of the oil application roller. An oil leakage prevention film is closely wound around the oil application roller so that the end portions of the film are liquid-tightly secured to the seal rings.

When an oil application roller is placed in an upright condition during storage, oil leakage is apt to occur at the lower end portion. By installing the seal rings at the ends, it is possible to prevent oil leakage, oil exuding along the shaft in particular.

The end portion or end portions of the oil application roller herein refer to the flat portion at one end or the flat portions at both end portions of the cylindrical oil application roller in its axial direction.

By securing both end portions of the oil leakage prevention film to the seal rings, the oil application roller can be tightly sealed with the seal rings and the oil leakage prevention film. With this structure, even if the oil application roller is turned upside down, oil does not leak and run down along the oil application roller.

The oil application roller unit of the present invention comprises a holder having at least bearings, an oil application roller held by the bearings so as to be rotatable with respect to the holder, and seal rings provided at both end portions of the oil application roller. An oil leakage prevention film, capable of being pulled out, is closely wound around the oil application roller to pack the roller, and is secured to the seal rings. By pulling the oil leakage prevention film in the state that the oil application roller remains installed in the holder, the film can be removed while the oil application roller is rotated.

When an oil application roller, provided with no seal rings and installed in the holder, is used for a long term, play generates between the shaft of the roller and the bearings, whereby the end portions of the oil application roller may be damaged because of the contact with the holder.

The oil application roller of the present invention, however, is not damaged because the seal rings are installed at both ends of the oil application roller. In addition, since the oil application roller can be positioned accurately with respect to the holder, the oil application roller is prevented from being damaged.

In addition, the oil application roller unit of the present invention comprises an oil application roller having vent holes at least at end portions thereof, and an oil leakage prevention film closely wound around the oil application roller to pack the roller. The vent holes are closed with the oil leakage prevention film.

When the shaft of the oil application roller having the vent holes is placed in a nearly vertical condition, oil soon leaks through the vent holes. This oil leakage can be prevented by closing the vent holes during storage. However, a member used to close the vent holes must be removed before use. If the user forgets to remove the member, the internal pressure inside the roller increases because of the increase in temperature during use. This may increase the initial application amount of oil, and in the worst case, the application roller may be broken.

In the present invention, the vent holes are closed with the oil leakage prevention film for packing the oil application roller. With this structure, oil leakage does not occur during storage. The vent holes are opened at the time of unpacking the roller before use. This prevents, therefore, the problem of forgetting to open the vent holes, whereby the oil application roller can be used safely.

Furthermore, in the oil application roller unit of the present invention, the oil application roller is provided with vent holes at the end portions thereof, and an oil leakage prevention film is closely wound around the oil application roller. Seal rings are provided at both ends of the oil application roller. The seal rings has gas release holes communicating with the interior of the oil application roller. The gas release holes are closed with the oil leak prevention film.

After release oil is injected into the oil holding layer, if an attempt is made to bond the oil leakage prevention film to the oil application roller, it is sometimes difficult to bond the oil leakage prevention film because of oil being present on the circular surface portion and the end portions of the oil application roller. For this reason, release oil should desirably be injected after the oil leakage prevention film is bonded. However, it is difficult to inject oil after the oil application roller is tightly sealed with the oil leakage prevention film. To solve this problem, seal rings having gas release holes, not allowing oil to pass through but allowing oil to be injected, are provided at the end portions of the oil application roller. After the seal rings are installed in the oil application roller, and the oil leakage prevention film is bonded to the roller, oil is injected through the gas release holes of the seal rings. Although oil is present at the end portions of the oil application roller because of oil injection, since the seal rings do not allow oil to pass through, oil is not attached to any portions other than the gas release holes of the seal rings.

In this condition, oil will leak through the gas release holes. By closing the gas release holes of the seal rings with the oil leakage prevention film in the end, oil leakage can be prevented. By removing the oil leakage prevention film before use, the gas release holes can be used as vent holes.

In the oil application roller unit of the present invention, the oil application roller is provided with vent holes at the end portions. Seal rings having gas release holes in the side surfaces thereof and communicating with the vent holes of the oil application roller are provided at both ends of the oil application roller. A heat-shrinkable oil leakage prevention film is closely wound around the oil application roller and the gas release holes, and made shrunk by heat. As a result, the oil application roller is packed, and the gas release holes are closed at the same time.

After release oil is injected into the oil holding layer, the oil leakage prevention film is bonded to the oil application roller. At this time, it is sometimes difficult to bond the oil leakage prevention film because of oil being present on the circular surface portion and the end portions of the oil application roller. By using the heat-shrinkable film as the oil leakage prevention film, the roller can be liquid-tightly packed without using any adhesive. The gas release holes should desirably be provided on the circular surface of the seal ring instead of its flat end surface in order to close the gas release holes with the oil leakage prevention film without using any adhesive. In other words, the gas release holes should desirably be grooves communicating with the vent holes at the side surfaces of the oil application roller and leading to the circumferential surface of the oil application roller.

In the oil application roller unit of the present invention, when the radius of the oil application roller is assumed to be a, the radius of the seal ring is in the range of 0.8a to 0.99a.

The application amount of oil by the oil application roller depends on the biting amount of the oil application roller with respect to the fixing roller. The biting amount is usually specified by the pressure of a spring or the like. However, if the cross section of the fixing roller is partially elliptical because of the deflection or the like of the oil application roller, nonuniform application occurs. A specified biting amount can be obtained at all times by setting the radius of the seal ring smaller than that of the oil application roller by a desired biting amount.

If the radius of the seal ring is more than 0.99a, the application amount of oil becomes too small, and hot offset occurs. On the other hand, if the radius of the seal ring is less than 0.8a, the application amount of oil becomes too large, and images are disturbed or the service life of the roller is shortened.

If the radius of the seal ring is far smaller than that of the oil application roller, the oil leakage prevention film becomes wrinkled at the time when the film is secured to the seal rings, thereby resulting in danger of causing oil leakage. In addition, clearances generate at the portions having a difference in level between the oil application roller and the seal rings, and leaked oil will accumulate in the clearances. When the roller is unpacked, the accumulating oil may spill, thereby staining equipment and the floor of the user's office.

The thermal expansion coefficient of the seal ring used for the oil application roller unit of the present invention is higher than that of the shaft. If the thermal expansion coefficient of the seal ring is lower than or equal to that of the shaft, steam generated because of heat during use inside the oil application roller cannot be discharged, since the seal rings are secured and used to tightly seal the oil application roller. If the thermal expansion coefficient of the seal ring is higher than that of the shaft, a clearance generates among the pressure-fit seal rings, the shaft and the oil application roller, when the oil application roller expands owing to the heat from the fixing roller. Steam or the like can thus be discharged directly from the vent holes through the clearance or via the sponge layer.

The seal ring used for the oil application roller unit of the present invention is made of an elastic material. The diameter of the seal rings used on the sides should be equal to that of the oil application roller at the time when the oil leakage prevention film is closely wound around the roller. However, if the seal ring is made of a rigid material, and its diameter is the same as that of the roller, the oil application roller cannot have any sufficient biting amount. On the other hand, if the seal ring is made of an elastic material, and its diameter is the same as that of the roller, the oil leakage prevention film can be closely wound and attached around the roller without causing clearances, and the oil application roller can have a sufficient biting amount during use.

Even if the seal ring is made of a rigid material and its diameter is the same as that of the roller, the oil application roller can have a sufficient biting amount during use, by making the distance between the two seal rings larger than the axial length of a mating roller making pressure contact with the oil application roller. In this case, the whole size of the fixing device becomes slightly larger.

The adhesive used in the present invention to secure the oil leakage prevention film to the oil application roller is applied to a continuous range at least from one end portion to the other end portion in the axial direction of the oil application roller.

If the adhesive is applied discontinuously onto the oil leakage prevention film, oil may flow from the surface of the oil application roller along the film, and may exude from portions to which no adhesive is applied. In the case of the present invention, however, the adhesive for securing the oil leakage prevention film at one end portion of the oil application roller is joined and becomes continuous to the adhesive for securing the oil leakage prevention film at the other end portion, in the vicinity of the winding end portion of the oil leakage prevention film. For this reason, oil exuding from the oil application roller cannot leak outside the region enclosed by the adhesive.

The adhesive for securing the oil leakage prevention film is applied to the continuous range from the one end portion to the other end portion in the axial direction of the oil application roller as described above. However, the adhesive may be applied to other regions to reinforce the secured portions.

The adhesive used in the present invention and applied to the oil leakage prevention film is characterized in that the application length of the adhesive applied in the direction perpendicular to the pulling direction of the oil leakage prevention film is ⅔ or less of the axial length of the oil application roller.

If the adhesive is applied along the entire length in the direction perpendicular to the pulling direction of the oil leakage prevention film, and when a tension is applied to pull the film, the tension is given to the adhesive dispersively. Hence, a large force is required to peel off the adhesive application portion. For this reason, the adhesive is not applied in the direction perpendicular to the pulling direction of the oil leakage prevention film, or the application length of the adhesive applied in the direction perpendicular to the pulling direction of the oil leakage prevention film is ⅔ or less of the axial length of the oil application roller. As a result, the pulling tension can be given effectively to the film, whereby the user can remove the oil leakage prevention film by applying a small force without fail.

The length of the adhesive application portion designates a length in the case when the adhesive application portion is assumed to be a single line along the center of the trace of the applied adhesive having a width.

The oil application roller of the present invention should desirably comprise an oil holding layer formed of a thick porous material and an oil permeation control layer formed of at least a porous fibrous material and attached around the oil holding layer.

The thick porous material used for the oil holding layer of the present invention should preferably be a material not damaged by the oil to be held and resistant against operation temperature. Such a material may include Nomex felt, Nomex braid, Nomex fiber bundle, glass fiber bundle, carbon fiber bundle, carbon fiber felt, various ceramic sintered porous materials, silicone rubber porous sponge, polyester polyurethane foam, aramid fiber bundle, polyimide foam, melamine foam, and other various plastic sponges, foams, porous materials, sintered materials, fiber bundles, etc., for example. Among these, the melamine foam is particularly preferable, since it is high in porosity, excellent in oil holding capability because of having pores with a proper diameter, and high in elasticity.

The porosity of any type of porous material must be 50% or more. If the porosity is less than 50%, the oil holding layer has a small oil holding amount, and the service life of the oil application roller becomes short. Therefore, the roller cannot be used for actual operation, although oil leakage does not occur.

In the oil application roller of the present invention, a porous fibrous material is provided on the surface of a thick porous material. However, an oil diffusion layer may be sandwiched between the thick porous material and the porous fibrous material. In this case, the oil diffusion layer should preferably have appropriate flexibility or elasticity to ensure proper contact with the mating roller to which oil is applied. In addition, the oil diffusion layer should preferably have high oil diffusion capability. The material for the oil diffusion layer may include Nomex felt, silicone rubber sponge, composite foam of urethane foam and silicone rubber, melamine foam, polyimide foam, and the like. In addition, the layer material may be combined with an elastic material, such as fluorine rubber, silicone rubber or the like.

In particular, a material produced by drawing polytetrafluoroethylene (PTFE) is best suited for the porous fibrous material used for the oil permeation control layer of the present invention in view of uniformity in porous structure and cavity structure, and the like. The thickness of the porous PTFE film is preferably in the range of 0.005 to 0.1 mm, but usable in the range of 0.001 to 1 mm. The porosity of the film is preferably in the range of 50 to 90%, but usable in the range of 20 to 98%. The average diameter of the pore is preferably in the range of 0.1 to 2 $\mu$m, but usable in the range of 0.05 to 15 $\mu$m.

Furthermore, the oil permeation control layer of the present invention may be formed of a composite material of a mixture of a porous fibrous material, silicone rubber and release oil. As a composite formation method used in this case, it is preferable to use a method wherein a porous fibrous film is impregnated with a mixture of silicone rubber and release oil, and subjected to cross-linking. The best suited silicone rubber used herein may include RTV (room temperature hardening type) silicone rubber, LTV (low temperature hardening type) silicone rubber, HTV (high temperature hardening type) silicone rubber, ultraviolet hardening type silicone rubber, etc. Moreover, silicon oil, particularly dimethyl silicone oil is used frequently as release oil. When a mixture of silicone rubber and release oil is subjected to impregnation and cross-linking, the mixture ratio of the silicone rubber and the release oil is set at 2:98 and the ratio is determined depending on the target amount of oil permeation. However, the amount of the release oil should preferably be smaller than the amount in the case of the ratio of 2:98. If the amount of release oil is larger, release oil cannot be contained in the silicone rubber, and is ungelatinized. As a result, the control of oil permeation becomes difficult. In addition, the impregnation amount of the mixture of the silicone rubber and release oil can be determined appropriately so that pores are filled 100% or less.

The porous fibrous material used for the oil permeation control layer of the oil application roller in accordance with the present invention may be formed of a conductive porous material having a conductive substance, such as carbon, in its thick or porous portion or in both portions.

In this case, the conductivity of the material can eliminate static electricity. It is thus possible to prevent trouble, such as the attachment of dust or toner to the surface of the oil application roller during storage owing to static electricity.

As a method of providing the oil permeation control layer on the surface of the oil holding layer, it is possible to use a method wherein a fluororesin, such as FEP, intervenes between the two layers and laminated under heat and pressure, a method wherein the two layers are bonded to each other by using a thermosetting adhesive, or the like. The oil permeation control layer of the present invention is a composite material of the mixture of a porous fibrous material, silicone rubber and release oil. After the porous fibrous material is attached under pressure or bonded to the thick porous material, the cross-linked material formed of the mixture of silicone rubber and release oil is applied to the surface of the porous fibrous material. Alternatively, after the porous fibrous material is immersed in the mixture so that the porous portion is impregnated with the mixture, the remainder on the surface is wiped away. After wiping away the remainder, it is preferable that an oil permeation control layer is provided by cross-linking. With this method, the oil permeation control layer is integrally joined with the thick porous material. As a result, the oil permeation control layer is effectively prevented from being falling off, and the durability of the roller can be enhanced further. In addition, if the durability is sufficiently high, it is possible to use the integrally joined structure obtained by the cross-linking, without using any adhesive.

In the present invention, at least one vent hole is provided at each end portion of the oil application roller in the axial direction thereof. The vent hole is not necessarily required to be a circular hole. The hole may be a doughnut-shaped hole provided around the shaft of the roller. The size of the hole is not specified in particular. However, if the hole is too large, oil leakage will occur during normal use. Hence, when it is assumed that the radius of the oil application roller minus the radius of the shaft is b, it is desirable that the hole is provided within the range of 1/2b from the circumferential surface of the shaft.

The release oil used for the present invention may include dimethyl silicone oil, fluorine oil, fluorosilicone oil, phenyl silicone oil, amino-denatured silicone oil, various types of denatured silicon oils, etc. Although the viscosity of the oil is not limited particularly, it is preferable to use fluorosilicone oil or amino-denatured silicone oil in view of viscosity.

The material of the shaft used for the present invention may be made of various types of metals, such as aluminum, steel and stainless steel.

The material of the seal ring of the present invention must not be damaged by oil to be used and must be resistant against operation temperature. The material may be selected from heat-resistant resins, such as polyacetal, polycarbonate, polyphenylene sulfide, polyether sulphone, polyether imide, polyamideimide and polyimide. Alternatively, the material may also be selected from various types of metals, such as aluminum, steel and stainless steel, or various elastic materials formed of rubber, such as urethane rubber, silicone rubber, fluorine rubber, phlorosilicone rubber, EPDM (ethylene propylene rubber) and hydrin rubber.

The oil leakage prevention film used for the present invention must not be damaged by oil to be used, and the material of the film may include PET, polyethylene, polypropylene, polyvinyl alcohol, polyvinyl chloride, polycarbonate, polystyrene, cellophane, Nylon, etc. The thickness of the oil leakage prevention film is in the range of 10 to 100 $\mu$m.

The shape of the oil leakage prevention film may be square, triangular, trapezoidal, parallelogramic, etc., provided that the oil application roller can be covered with the film completely.

The oil leakage prevention film may be provided with a tab so that the tab is clearly identified as the portion to be pulled by the user when removing the film.

The heat-shrinkable oil leakage prevention film used for the present invention must be heat-shrinkable and must not be damaged by the oil to be used for the oil application roller, and the material of the film may be selected from PET, polyvinyl chloride, polyester, polystyrene, etc. The thickness of the oil leakage prevention film is in the range of 10 to 100 $\mu$m.

It is desirable that the shrinkage coefficient of the heat-shrinkable oil leakage prevention film in the direction perpendicular to the axial direction of the oil application roller is five times as large as or more than that in the axial direction.

The shape of the heat-shrinkable oil leakage prevention film may be square, triangular, trapezoidal, parallelogramic, etc., provided that the oil application roller can be covered with the film completely.

The heat-shrinkable oil leakage prevention film may be provided with a tab so that the tab is clearly identified as the portion to be pulled by the user when removing the film.

It is preferable that the adhesive used for the present invention can be bonded to the oil leakage prevention film made of the above-mentioned various types of materials, and has a bonding strength allowing the oil leakage prevention film to be peeled off easily when the film is pulled. This type of adhesive may be selected from EVA-based adhesive, polyamide-based adhesive, polyester-based adhesive, polyethylene-based adhesive, synthetic-rubber-based adhesive, ethylene-ethylacrylate-based adhesive, atactic-polypropylene-based adhesive, polyvinyl-acetate-based adhesive, etc. These adhesives can be used provided that they can be bonded to the oil leakage prevention films made of the above-mentioned materials.

The fixing device having the oil application roller unit of the present invention comprises fixing means for fixing toner to a recording medium under the action of heat and pressure, an oil application roller rotatably supported by a holder, and an oil leakage prevention film capable of being pulled out. By pulling the oil leakage prevention film in the state that the oil application roller is installed in the holder, the oil leakage prevention film can be removed while the oil application roller is rotated.

Any types of fixing means can be used as the fixing means of the present invention, provided that the oil application roller can be installed therein. It is desirable to use a heat roller type having an elastic material on the surface.

Preferred embodiments in accordance with the present invention will be described below in detail referring to FIG. 1 to FIG. 18.

First Embodiment

First embodiment will be described below referring to FIG. 1 to FIG. 5.

FIG. 1 is a sectional side view showing a color electrophotographic printer for full-color image formation in accordance with the present embodiment. Referring to FIG. 1, the color electrophotographic printer (hereinafter simply referred to as a printer) has an external housing 101. The front surface of the printer is on the right end side of the figure. The front plate 101A of the printer can be opened to the position indicated by the broken lines, by rotation around a hinge shaft 101B located at the lower portion of the front plate with respect to the external housing 101 of the printer. The front plate 101A can be closed to the position indicated by the solid lines. When an intermediate transfer belt unit 102 is mounted or dismounted inside the printer, or when inspection, maintenance or the like is carried out inside the printer at the time of paper jam or the like, the front plate 101A of the printer is opened so that the interior of the printer can be accessed easily. The direction of mounting/dismounting the intermediate transfer belt unit 102 is designed so as to be perpendicular to the axial direction of the rotation shaft of a photoconductive member 111.

Figure 2:
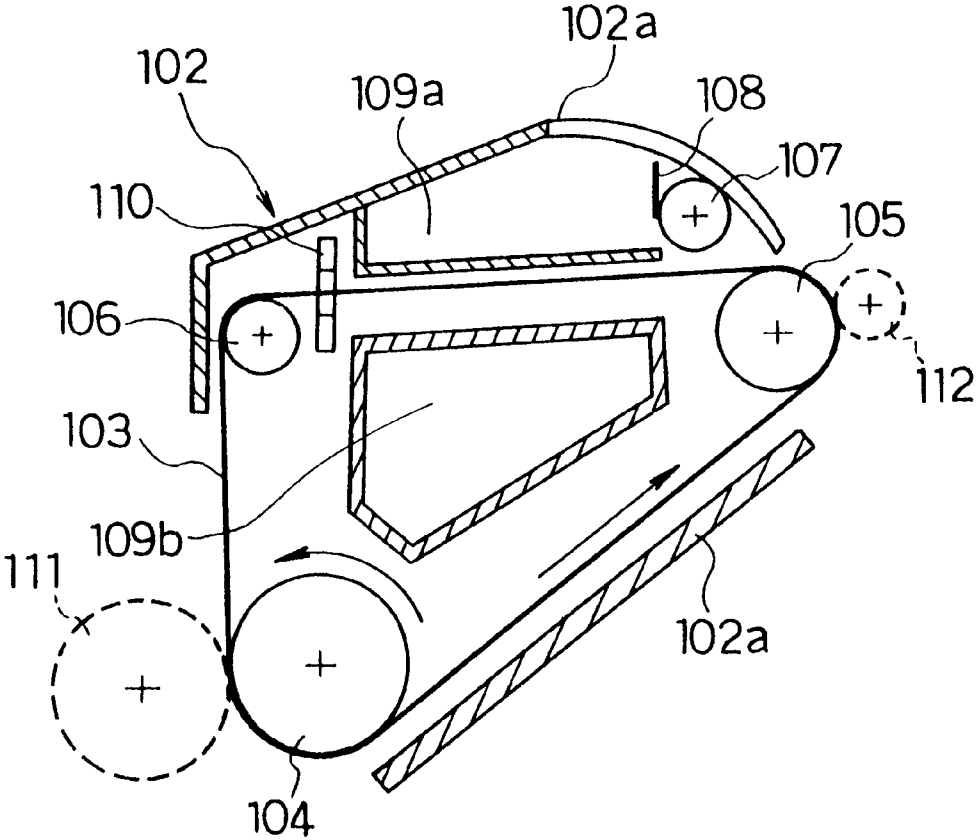
FIG. 2 is a sectional side view showing a transfer unit in accordance with the first embodiment of the present invention.

FIG. 2 shows the structure of the intermediate transfer belt unit 102. The intermediate transfer belt unit 102 comprises an intermediate transfer belt 103, a first transfer roller 104 formed of a conductive elastic body, a second transfer roller 105 formed of an aluminum roller, and a tension roller 106 for adjusting the tension of the intermediate transfer belt 103. These components of the intermediate transfer belt unit 102 are housed in a unit housing 102*a*. Furthermore, a belt cleaner roller 107 for removing toner remaining on the intermediate transfer belt 103, a scraper for scraping toner collected on the cleaner roller 107, waste toner reservoirs 109*a* and 109*b* for storing collected toner, and a position detector 110 for detecting the position of the intermediate transfer belt 103 are also housed inside the unit housing 102*a*. This intermediate transfer belt unit 102 can be mounted to or dismounted from the predetermined accommodation portion inside the external housing 101 of the printer through the open space obtained when the front plate 101A of the printer is opened as indicated by the broken lines as shown in FIG. 1.

The intermediate transfer belt 103 is formed of a film made by kneading a conductive filler in an insulating resin and extruding the mixture into the shape of a film. In the present embodiment, 95 parts by weight of a polycarbonate resin (IUPILON Z300 made by Mitsubishi Gas Chemical Co., Ltd., for example) used as an insulating resin, are combined with 5 parts by weight of conductive carbon (KETJEN BLACK, for example), and formed into a film. Moreover, the surface of the film is coated with a fluororesin. The film measures about 350 $\mu$m in thickness, and has a resistivity of about $10^7$ to $10^8$ $\Omega$·cm. In the present embodiment, the intermediate transfer belt 103 is formed of a film made by kneading a polycarbonate resin with a conductive filler and by forming the mixture into a film as described above, to effectively prevent the intermediate transfer belt 103 from being slackened and electrically charged owing to its use for a long term. Furthermore, the surface of the belt is coated with a fluororesin to effectively prevent toner from attaching to the surface of the intermediate transfer belt owing to its use for a long term.

A film basically formed of semiconductive urethane and shaped like an endless belt having a thickness of 100 $\mu$m is used as another concrete example of the intermediate transfer belt 103. This film is supported by the first transfer roller 104, the second transfer roller 105 and the tension roller 106 so as to be movable in the direction indicated by the arrow. These rollers are covered with a urethane foam treated to have a low resistance of $10^7$ $\Omega$·cm. The circumferential length of the intermediate transfer belt 103 is set at 360 mm, that is, the longitudinal length (298 mm) of A4-size paper (the maximum usable paper) plus a length (62 mm) slightly longer than the half of the circumferential length of a photosensitive drum (30 mm in diameter) described later.

When the intermediate transfer belt unit 102 is installed in the printer body, the first transfer roller 104 is pressed against the photosensitive member 111 indicated by a dotted line in FIG. 2 at a force of about 1.0 kg via the intermediate transfer belt 103. Furthermore, the second transfer roller 105 is also pressed against the third transfer roller 112 shown by a dotted line in FIG. 2 via the intermediate transfer belt 103, just like the above-mentioned first transfer roller 104. The third transfer roller 112 is driven by the intermediate transfer belt 103 so as to rotate.

The cleaner roller 107 is a roller for the belt cleaner section, and used to clean the intermediate transfer belt 103. The cleaner roller 107 is a metallic roller, and supplied with alternating current to electrostatically adsorb toner. A rubber blade or a conductive fur brush applied with a voltage may be used as the cleaner roller 107.

Referring to FIG. 1, four fan-shaped image formation units 117Bk, 117C, 117M and 117Y, corresponding to black, cyan, magenta and yellow, respectively, are disposed annularly at the central portion of the printer as shown in the figure to form an image formation unit assembly 118. The image formation units 117Bk, 117C, 117M and 117Y can be mounted to and dismounted from the predetermined positions in the image formation unit assembly 118 when the top plate 101C of the printer is opened around its hinge shaft 101D. When the image formation units 117Bk, 117C, 117M and 117Y are mounted to the predetermined positions inside the printer, the mechanical drive system and the electrical system of the image formation unit assembly 118 are connected to those of the printer via coupling members (not shown), whereby the image formation unit assembly and the printer are integrated mechanically and electrically.

The image formation units 117Bk, 117C, 117M and 117Y disposed annularly are supported by a support member (not shown) and driven by a movement motor 119 used as a movement means via a drive mechanism (not shown), thereby rotating around a stationary cylindrical shaft 120. In accordance with the rotation, the image formation units 117Bk, 117C, 117M and 117Y can be sequentially positioned at an image formation position 121 opposed to the second transfer roller 104 for supporting the above-mentioned intermediate transfer belt 103. The image formation position 121 is a position wherein exposure is carried out by a signal light beam 122.

The image formation units 117Bk, 117C, 117M and 117Y each comprise the same components except for a developing agent included therein. To simplify explanation, the image formation unit 117Bk for black is taken as an example and described below. The explanations of the other units are thus omitted.

A laser beam scanner section 135 is disposed at a lower portion inside the external housing 101 of the printer, and comprises a semiconductor laser (not shown), a scanner motor 135*a*, a polygon mirror 135*b*, a lens system 135*c* and the like. This laser beam scanner 135 emits a pixel laser signal light beam 122 corresponding to the time-series electrical pixel signal of image information. The pixel laser signal light beam 122 passes through an optical path window 136 formed between the image formation units 117 Bk and 117Y, also passes through a window 137 opened at a part of the shaft 120, and strikes a stationary mirror 138 inside the shaft 120. After reflected by the mirror 138, the pixel laser signal light beam 122 passes through an exposure window 125 of the image formation unit 117Bk, located at the image formation position 121, and enters the image formation unit 117Bk in a nearly horizontal direction. Next, the pixel laser signal light beam 122 passes through the path between a developing agent reservoir 126 and a cleaner 134, disposed at the upper and lower positions in the image formation unit, respectively. The light beam enters the exposure portion on the left side surface of the photosensitive member 111, and scanning and exposure are carried out in the axial direction.

The clearance between the image formation units 117 Bk and 117Y is used as the optical path from the optical path window 136 to the mirror 138. For this reason, the space near the image formation units assembly 118 is used effectively. Furthermore, the mirror 138 is provided at the central portion of the image formation unit assembly 118. Therefore, the mirror 138 can be formed of a single stationary mirror which has a single configuration and is easy in positioning.

The third transfer roller 112 is disposed above a paper feed roller 139 inside the front plate 101A of the printer. The pressure-contact portion between the intermediate transfer belt 103 and the third transfer roller 112, i.e., a nip portion, is provided with a paper transfer path so that paper is fed by the paper feed roller 139 provided below the front plate 101A of the printer.

A paper feed cassette 140 is disposed under the front plate 101A of the printer so as to project outward. The cassette can simultaneously accommodate plural types of paper 150. Paper 150 is fed via paper transfer timing rollers 141*a* and 141*b*, a fixing roller 1 and a pressure roller 7 provided at the upper portion in the printer, a paper guide plate provided between the third transfer roller 112 and the pair of rollers comprising the fixing roller 1 and the pressure roller 7, and a pair of paper ejection rollers 144*a* and 144*b* disposed on the paper exit side of the fixing roller 1.

The fixing roller 1 makes contact with a cleaning roller 14 and an oil application roller 15 for applying silicone oil to the fixing roller 1. The cleaning roller 14 and the oil application roller 15 are held by a holder 16.

The image formation units 117Bk, 117C, 117M and 117Y are each provided with a waste toner reservoir 134, and the intermediate transfer belt unit 102 is provided with the waste toner reservoir 109*b*.

The operation of the printer in accordance with the present embodiment will be described below.

First, the image formation unit 117Bk of the image formation unit assembly 118 is positioned at the image formation position 121 as shown in FIG. 1. At this time, the photosensitive member 111 is opposed to and makes contact with the first transfer roller 104 via the intermediate transfer belt 103.

At an image formation step, a signal light beam for a black image is emitted from the laser beam scanner section 135, and enters the image formation unit 117Bk, whereby an image is formed by black toner. At this time, the image formation speed of the image formation unit 117Bk (60 m/s being equal to the circumferential speed of the photosensitive member) is set to be equal to the moving speed of the intermediate transfer belt 103. At the same time when image formation is carried out, a black toner image is transferred to the intermediate transfer belt 103 wound around the first transfer roller 104. At this time, a direct-current voltage of +1 kV is applied to the first transfer roller 104. Immediately after the black toner image has been transferred completely, the entire image formation unit assembly 118 comprising the image formation units 117Bk, 117C, 117M and 117Y is driven by the movement motor 119, and rotates in the direction indicated by an arrow. After rotation of 90 degrees, the image formation unit 117C reaches the image formation position 121 and stops at this position. The components other than the photosensitive member 111 in each of the image formation units 117Bk, 117C, 117M and 117Y, i.e., the toner hopper 126 and the cleaner 134, do not make contact with the intermediate transfer belt 103, since they are disposed inward from the circular route taken by the outermost surface of the photosensitive member 111 at the time of rotation.

After the image formation unit 117C has reached the image formation position 121, the signal light beam 122 for a cyan image is emitted from the laser beam scanner section 135, and enters the image formation unit 117C, whereby a cyan toner image is formed and transferred just as described above. Until this moment, the intermediate transfer belt 103 takes one turn, and the writing timing of the signal light beam for the cyan image is controlled so that the position of the cyan toner image is aligned with the position of the black toner image previously transferred. At this time, the third transfer roller 112 and the cleaner roller 107 are positioned slightly away from the intermediate transfer belt 103 so as not to damage the toner image formed on the intermediate transfer belt 103.

The same operation as that described above is also carried out to form magenta and yellow toner images. As a result, the four color toner images are superimposed on the intermediate transfer belt 103 so that their positions are aligned. After the last yellow toner image is transferred, the four color toner images are transferred all together by the operation of the third transfer roller 112 to paper 150 fed from the paper feed cassette 140 in proper timing. At this time, the second transfer roller 105 is grounded, and a direct-current voltage of +1.5 kV is applied to the third transfer roller 112. The toner images transferred to the paper is fixed by the fixing roller 1 and the pressure roller 7. The paper then passes through the pair of paper ejection rollers 144*a* and 144*b*, and is ejected outside the printer. After the transfer, the toner remaining on the intermediate transfer belt 103 is removed by the cleaning operation of the cleaner roller 107 so as to be ready for the next image formation.

Next, the operation in the monochrome mode for forming a single-color image will be described below. In the monochrome mode, first, an image formation unit for a predetermined color, for example, the image formation unit 117Bk, is moved to the image formation position 121. Next, the image for the predetermined color is formed and transferred to the intermediate transfer belt 103, in a manner similar to the above-mentioned multi-color image formation. After the transfer, the image is further transferred by the third transfer roller 112 to paper 150 fed from the paper feed cassette 140, and is finally fixed.

Image formation units configured in accordance with other development methods having been known may also be used for the present invention.

The fixing device used for the embodiment of the present invention will be described below.

Figure 3:
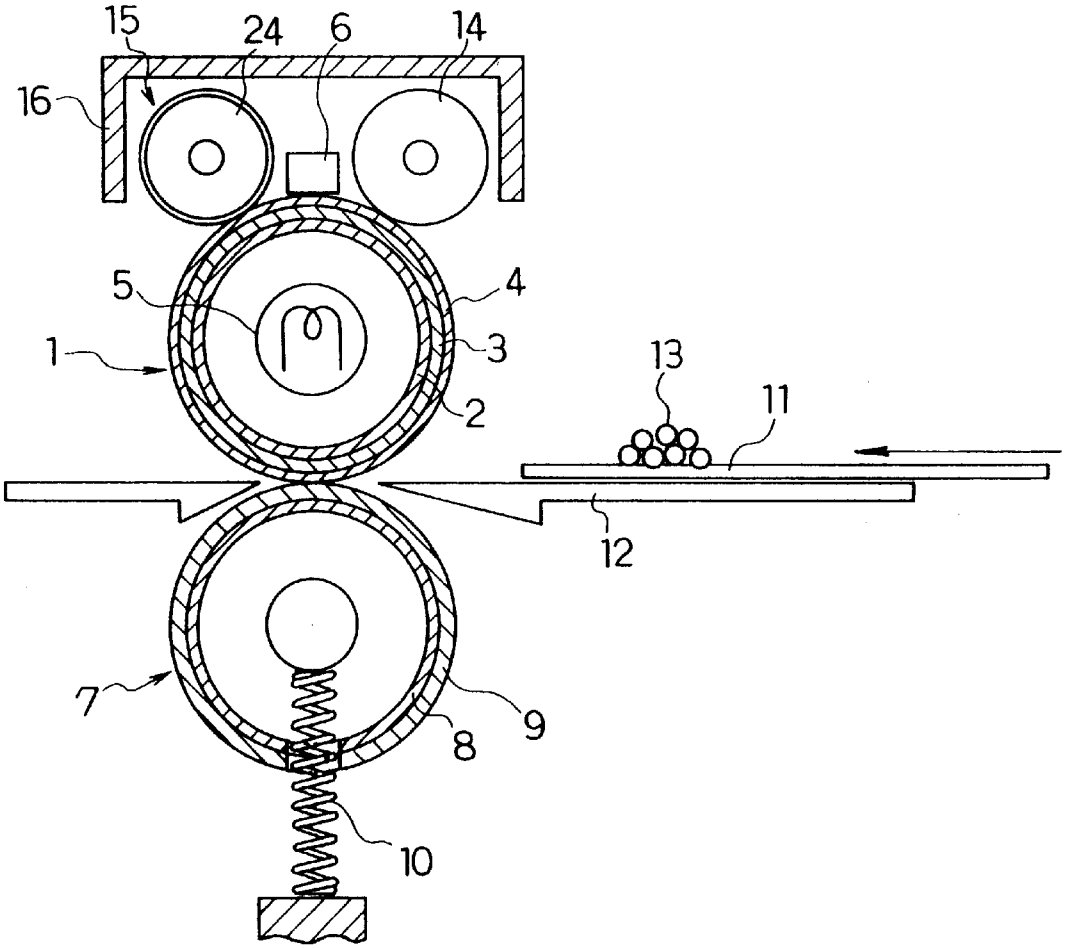
FIG. 3 is a sectional side view showing a fixing device in accordance with the first embodiment of the present invention.

Referring to FIG. 3, the fixing device comprises the fixing roller 1 and the pressure roller 7. The fixing roller 1 is formed of a metallic hollow roller core 2 and an elastic layer 3 provided on the external surface of the roller core. The pressure roller 7 is formed of a metallic hollow roller core 8 and an elastic layer 9 provided on the external surface of the roller core. Furthermore, a fluororesin tube 4 is provided on the elastic layer 3. A heater 5 is provided inside the fixing roller 1, and a temperature sensor 6 is provided on the outer surface of the fixing roller 1. The pressure roller 7 is pressed against the fixing roller 1 by pressure springs 10. A recording medium 11 with color toner 13 placed thereon is moved along a guide plate 12. In addition, the cleaning roller 14 and the oil application roller 15 are held by the holder 16, and disposed so as to make contact with the fixing roller 1. The fixing roller 1 used as a fixing member is formed of the hollow roller core 2 measuring 250 mm in length, 28 mm in outer diameter and 1 mm in thickness and made of aluminum. The elastic layer 3 made of silicone rubber having a rubber hardness of 30 deg. in accordance with JIS (Japan Industrial Standard-A) and measuring 1 mm in thickness is provided on the surface of the roller core 2. This elastic layer 3 is covered with the fluororesin tube 4 made of PFA and having a surface roughness Rz of 1.0 $\mu$m and a thickness of 30 $\mu$m. The fixing roller 1 thus measures about 30 mm in outer diameter.

The fixing roller 1 has the heater 5, a 600 W lamp, provided inside for heating, and is rotated at a speed of 100 mm/s, driven by a drive motor (not shown).

The pressure roller 7 used as a pressure member measures 250 mm in length and 30 mm in outer diameter. It is formed of the hollow roller core 8 measuring 28 mm in outer diameter and 1 mm in thickness and made of aluminum. The elastic layer 9 made of silicone rubber having a rubber hardness of 55 deg. in accordance with JIS and measuring 1.5 mm in thickness is provided on the surface of the roller core 8. This pressure roller 7 is disposed rotatably. A nip portion having a width of 3.5 mm is formed between the pressure roller 7 and the fixing roller 1 by using the springs 10 having a spring load of 15 kgf, one spring on each side.

The cleaning roller 14 used as a cleaning member is a hollow roller measuring 240 mm in length, 20 mm in outer diameter and 1 mm in thickness and made of aluminum. In addition, the cleaning roller 14 is pressed against the fixing roller 1 at a load of 50 gf/cm.

The oil application roller 15 used as an oil application member has an oil holding portion measuring 240 mm in length and 20 mm in outer diameter. Furthermore, the oil application roller is pressed against the fixing roller 1 at a load of 50 gf/cm.

The oil application roller of the present invention will be described below.

Figure 4:
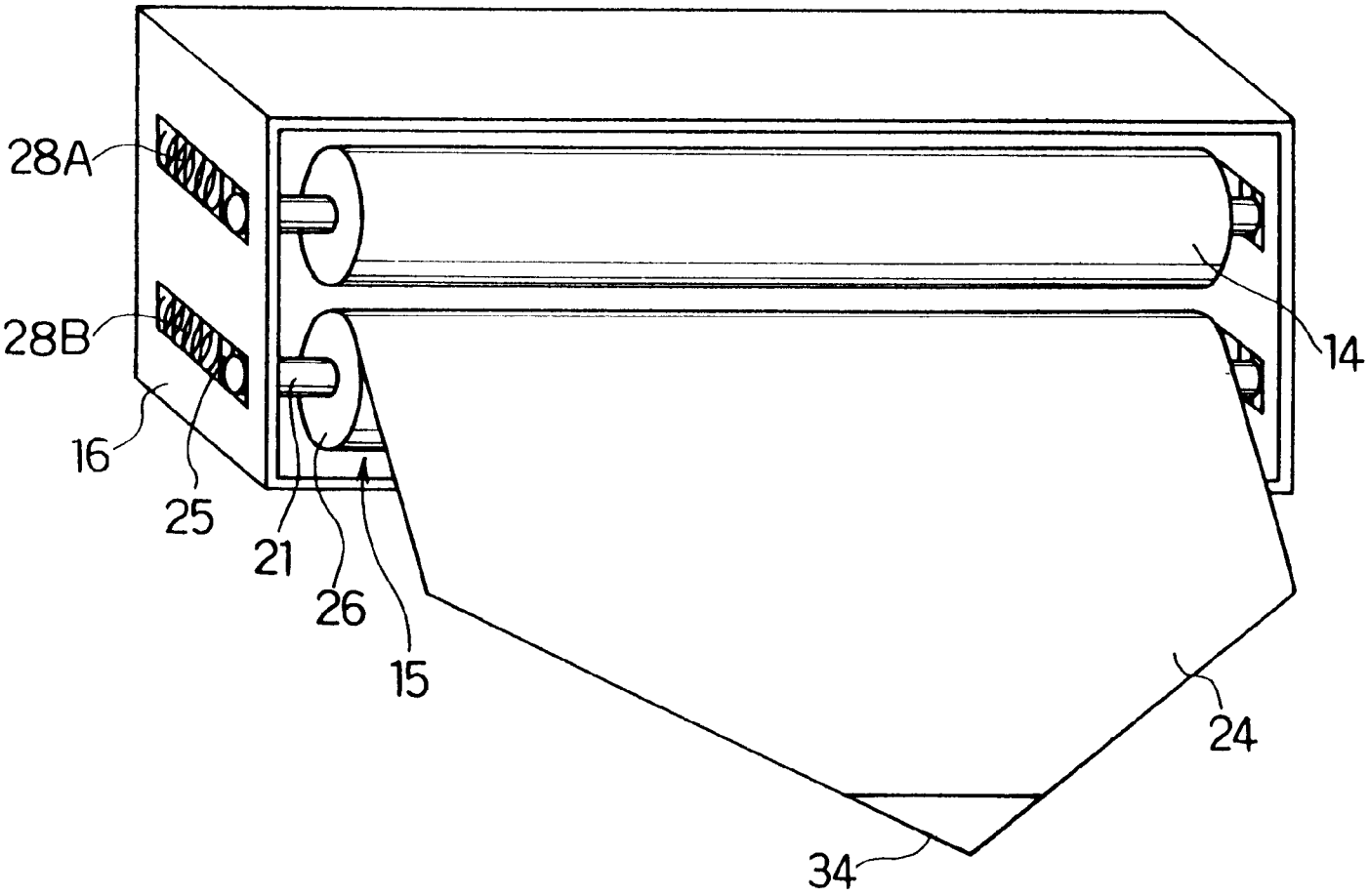
FIG. 4 is a perspective view showing an oil application roller unit in accordance with the first embodiment of the present invention.
Figure 5:
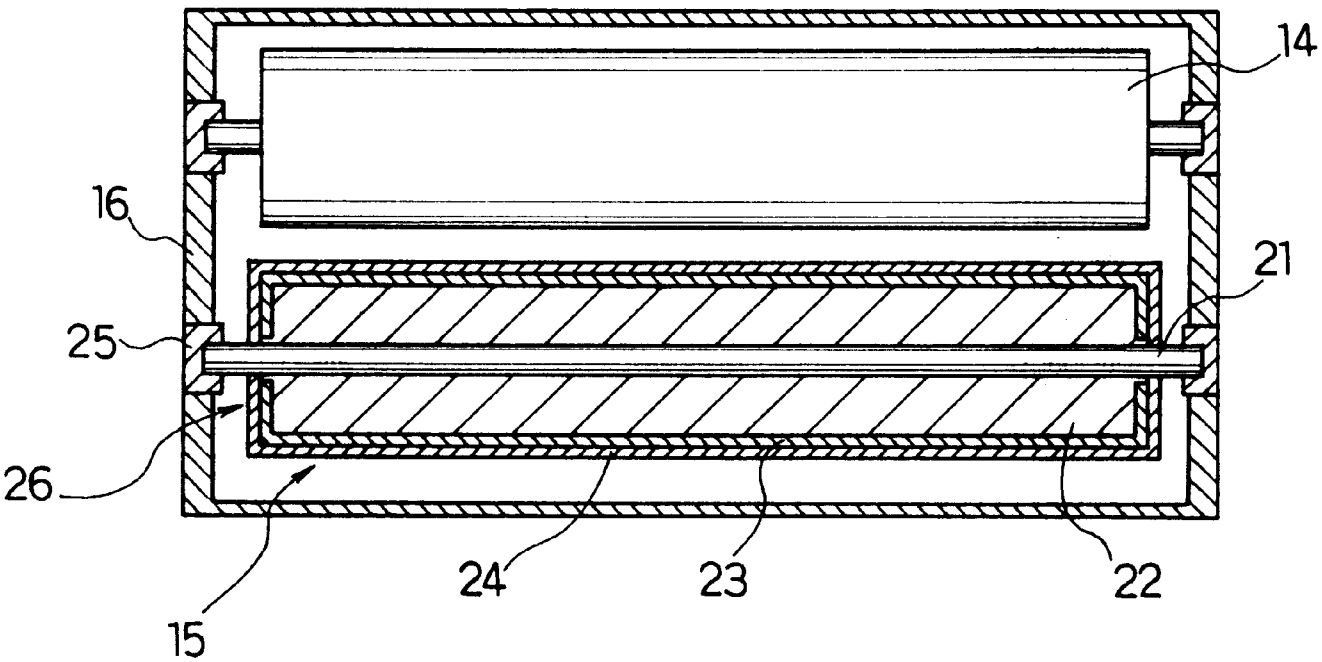
FIG. 5 is a sectional view showing the oil application roller unit in accordance with the first embodiment of the present invention.

FIG. 4 is a perspective view showing an oil application roller unit in accordance with the embodiment of the present invention, and FIG. 5 is a sectional view showing the oil application roller unit. The oil application roller unit shown in FIG. 4 is in a condition being ready for installation in a color printer. The oil application roller 15 is held by the holder 16, and an oil leakage prevention film 24 is wound on the external surface of the roller. The shaft 21 of the roller is supported by bearings 25. The cleaning roller 14 is provided at the upper portion of the holder 16, and held by the holder 16. The flat portion at each end of the oil application roller 15 is referred to as an end portion 26 of the oil application roller. The cleaning roller 14 and the oil application roller 15 are pressed against the fixing roller by springs 28A and 28B, respectively. Referring to FIG. 5, the oil application roller 15 has an oil holding layer 22 and an oil permeation control layer 23.

Figure 12:
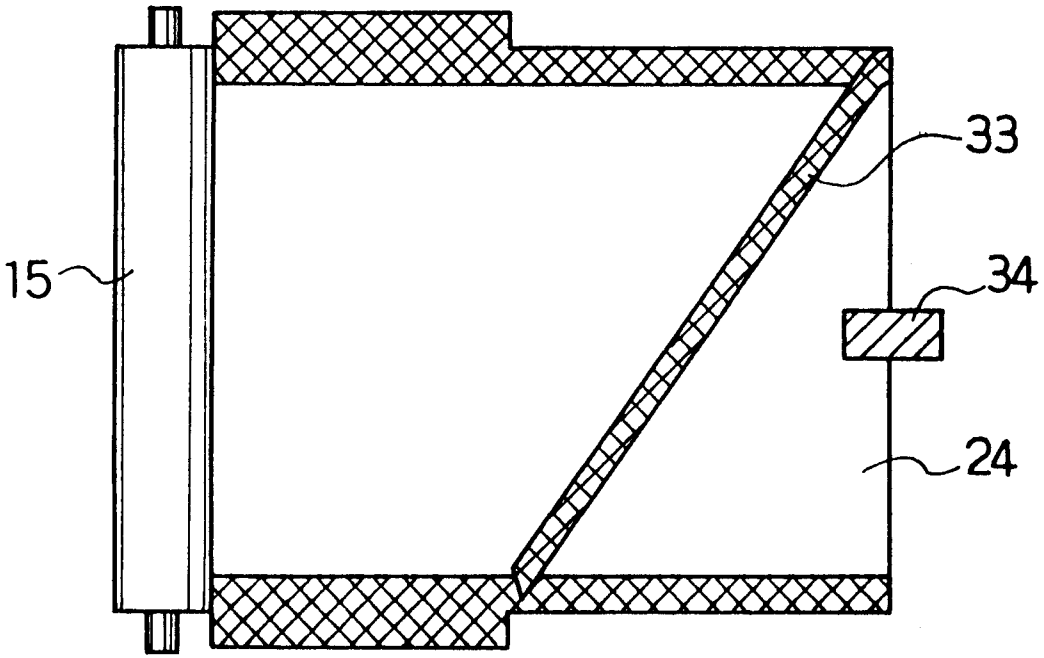
FIG. 12 is a plan view showing an oil leakage prevention film in accordance with the first embodiment of the present invention in a condition of being wound around the oil application roller.

Next, a method of producing the oil application roller 15 will be described below. A melamine foam (trade name BASOTECT made by BASF) having a porosity of 82% and used as an oil holding layer 22 is cut in the shape of a cylinder measuring 6 mm in inner diameter and 19 mm in outer diameter, for example. The shaft 21 made of steel and having a diameter of 6 mm is inserted into the oil holding layer 22 and fused thereto. Next, a silicone-based adhesive is applied in dots to the surface of a drawn porous PTFE film (trade name Gore-Tex made by Japan Gore-Tex Inc.) measuring 100 μm and provided with pores having a diameter of 0.2 μm on average and a porosity of 75%, and the film is wound around and bonded to the surface of the melamine foam 22. This drawn porous PTFE film is then impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture is removed by scraping. The film is then heated at 150 deg. C. for 40 minutes to cause cross-linking, thereby forming a composite film used as the oil permeation control layer 23. Fluorosilicone oil (FS1265 made by Dow Corning Toray Silicone Co., Ltd.) is then injected at the end portions 26 of the above-mentioned melamine foam 22. In order to tightly pack the oil application roller 15, the oil leakage prevention film 24 formed of a PET film and coated with an adhesive 33 (#8512US made by Sekisui Chemical Co., Ltd.) at the hatched portion as shown in FIG. 12 is closely wound around and bonded to the oil application roller 15 at a high temperature. At this time, the oil leakage prevention film 24 is also bonded to the end surfaces 26 of the oil application roller 15. The oil leakage prevention film 24 is provided with a tab 34 at its end. After the oil application roller 15 is tightly sealed in this way, the roller is rotated so that oil is distributed uniformly by centrifugal force. As shown in FIG. 4, the shaft 21 is inserted into the bearings 25, and the oil application roller 15 is installed in the holder 16.

When the tab 34 was pulled by hand to unpack the oil application roller 15 produced as described above, it was possible to unpack the roller by applying a very slight force. In addition, the hand is not stained with oil.

When toner images obtained by the image formation apparatus shown in the figure were fixed by the fixing device using the above-mentioned oil application roller 15, it was possible to obtain properly fixed images even after the fixing process was carried out 20,000 times.

Second Embodiment

Figure 6:
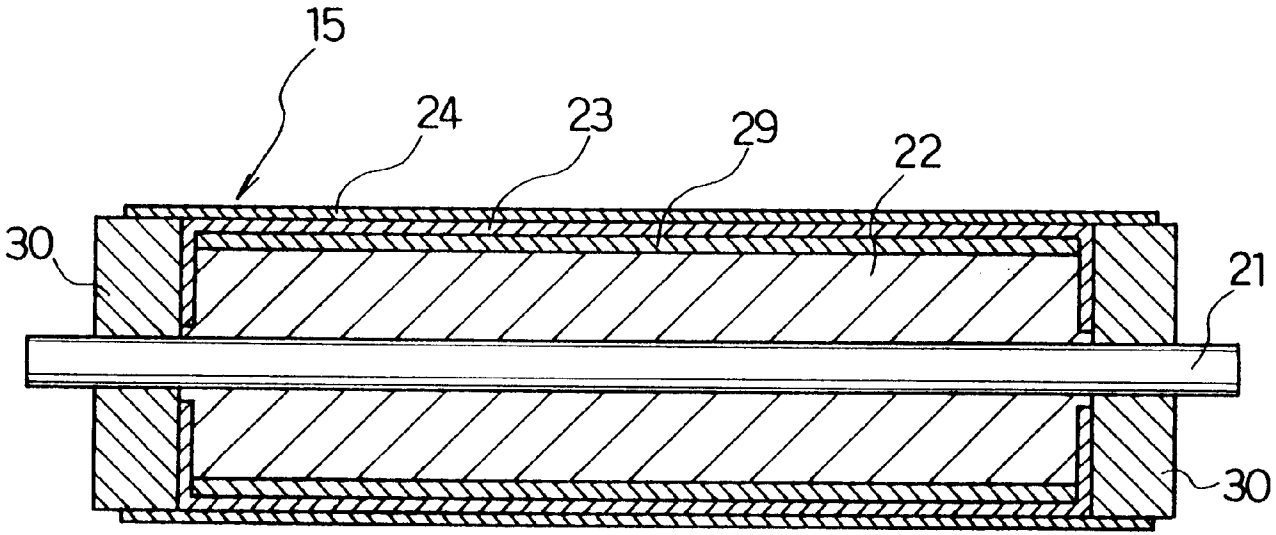
FIG. 6 is a sectional view showing an oil application roller in accordance with a second embodiment of the present invention.
Figure 13:
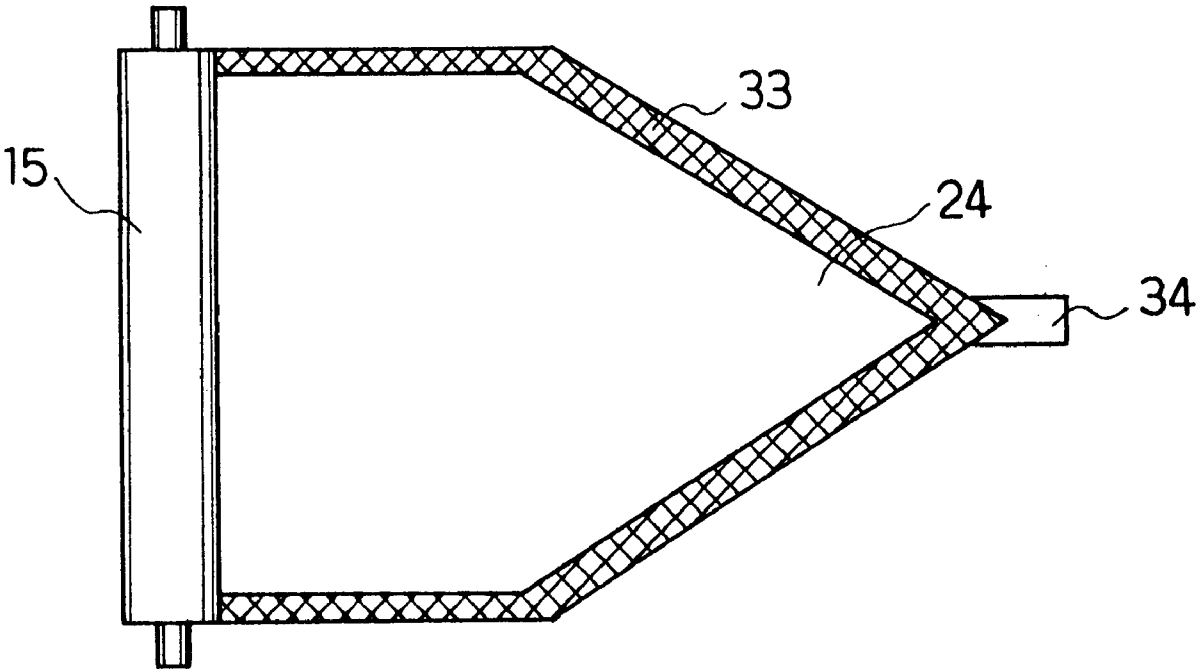
FIG. 13 is a plan view showing an oil leakage prevention film in accordance with the second embodiment of the present invention in a condition of being wound around the oil application roller.

FIG. 6 is a sectional view showing a second embodiment of the oil application roller of the present invention. A polyester-based polyurethane foam used as the oil holding layer 22 was cut in the shape of a cylinder measuring 6 mm in inner diameter and 17 mm in outer diameter. The shaft 21 made of SUS416 and having a diameter of 6 mm was inserted into the oil holding layer 22 and fused thereto. Furthermore, Nomex felt measuring 2 mm in thickness was cut in the shape of a tape measuring 30 mm in width. This tape was wound spirally around the oil holding layer 22 and bonded thereto by using a silicon-based adhesive to form an oil diffusion layer 29. Moreover, a silicone-based adhesive was applied in dots to the surface of a drawn porous PTFE film (trade name Gore-Tex made by Japan Gore-Tex Inc.), a porous fibrous material, measuring 100 μm in thickness and provided with pores having a diameter of 0.2 μm on average and a porosity of 75%, and the film was wound around and bonded to the surface of the layer 29. In addition, this drawn porous film was then impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture was removed by scraping. The film was then heated at 150 deg. C. for 40 minutes to cause cross-linking, thereby forming a composite film used as the oil permeation control layer 23. Fluorosilicone oil (FS1265 made by Dow Corning Toray Silicone Co., Ltd.) was then injected at the end portions 26 of the above-mentioned polyurethane foam. Subsequently, the end portions were tightly sealed with seal rings 30 made of polyphenylene sulfide. Next, the PET film 24 coated with the adhesive 33 (#8512US made by Sekisui Chemical Co., Ltd.) at the hatched portion as shown in FIG. 13 was closely wound around and bonded to the oil application roller 15 at a high temperature. At this time, the end portions of the film were bonded to the seal rings 30 to tightly seal the oil application roller. The roller was rotated so that oil was distributed uniformly by centrifugal force.

Although the oil application roller 15 produced as described above was placed in an upright condition during storage, oil did not leaked after one week. The roller was then turned upside down, and left in the condition for another week. No oil dripped down along the oil application roller 15, and no oil leakage is recognized.

Third Embodiment

Figure 7:
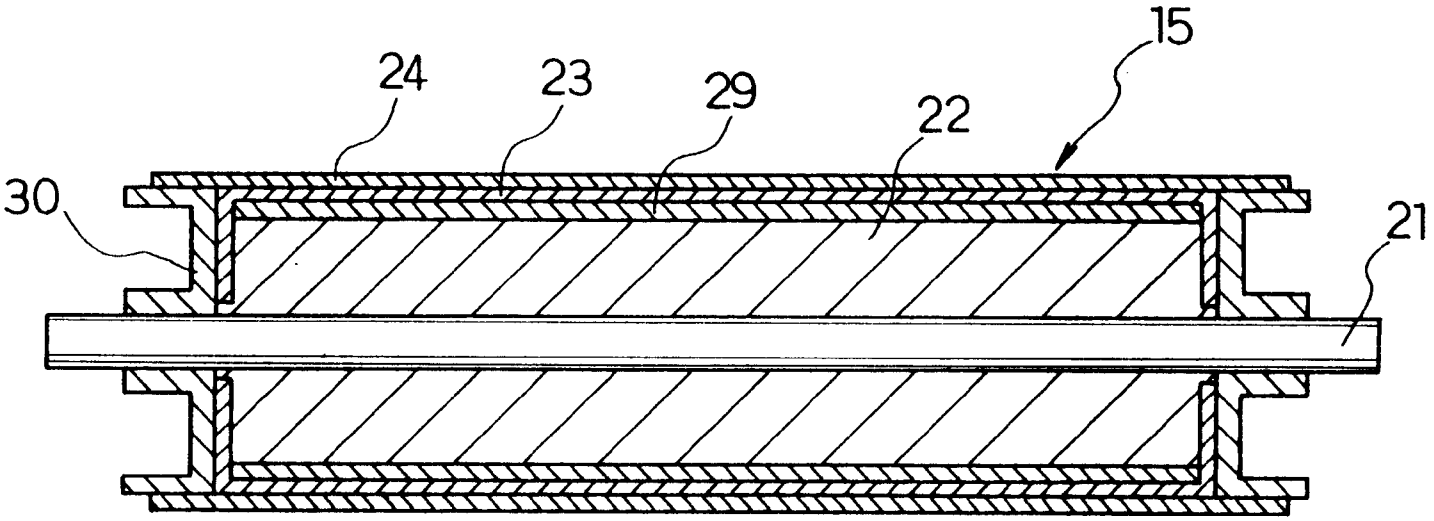
FIG. 7 is a sectional view showing an oil application roller in accordance with a third embodiment of the present invention.

FIG. 7 is a sectional view showing a third embodiment of the oil application roller of the present invention.

The third embodiment is the same as the second embodiment except that the seal ring 30 is changed to a silicone rubber seal ring having a sectional shape shown in FIG. 7. The oil application roller 15 having the configuration shown in FIG. 7 was configured.

When the oil application roller 15 produced as described above was installed in the apparatus shown in FIG. 1 in a manner similar to the first embodiment, the seal rings 30 were deformed by the pressure of springs (not shown) used to cause pressure contact of the oil application roller 15, thereby making it possible to obtain a desired biting amount.

Furthermore, it was possible to attain stable application even after the fixing process was carried out 20,000 times.

Fourth Embodiment

Figure 8:
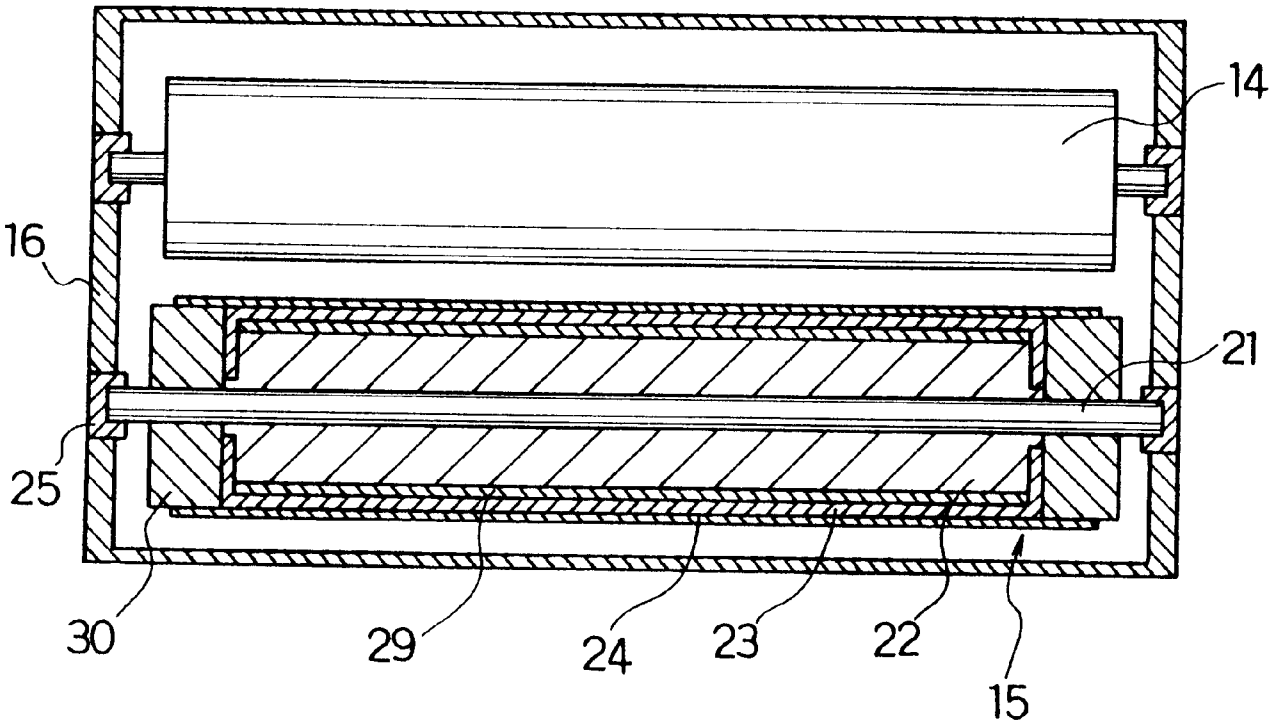
FIG. 8 is a sectional view showing an oil application roller unit in accordance with a fourth embodiment of the present invention.

FIG. 8 is a sectional view showing a fourth embodiment of the oil application roller of the present invention.

The shaft 21 of the oil application roller 15 produced as described in the second embodiment was inserted into the bearings 25, and installed in the holder 16. The oil application roller unit having the configuration shown in FIG. 8 was configured.

When the oil application roller unit produced as described above was installed in the apparatus shown in FIG. 1 in a manner similar to the first embodiment, the seal rings 30 expanded owing to the heat from the fixing roller 1, and a clearance was generated between the end portions of the oil permeation control layer 23 and the shaft 21. As a result, it was possible to discharge steam from the clearance.

Although the fixing process was carried out 20,000 times, the end portions of the roller were retained at their predetermined positions without causing damage to the end portions owing to contact with the bearings, whereby it was possible to carry out stable oil application.

Fifth Embodiment

Figure 9:
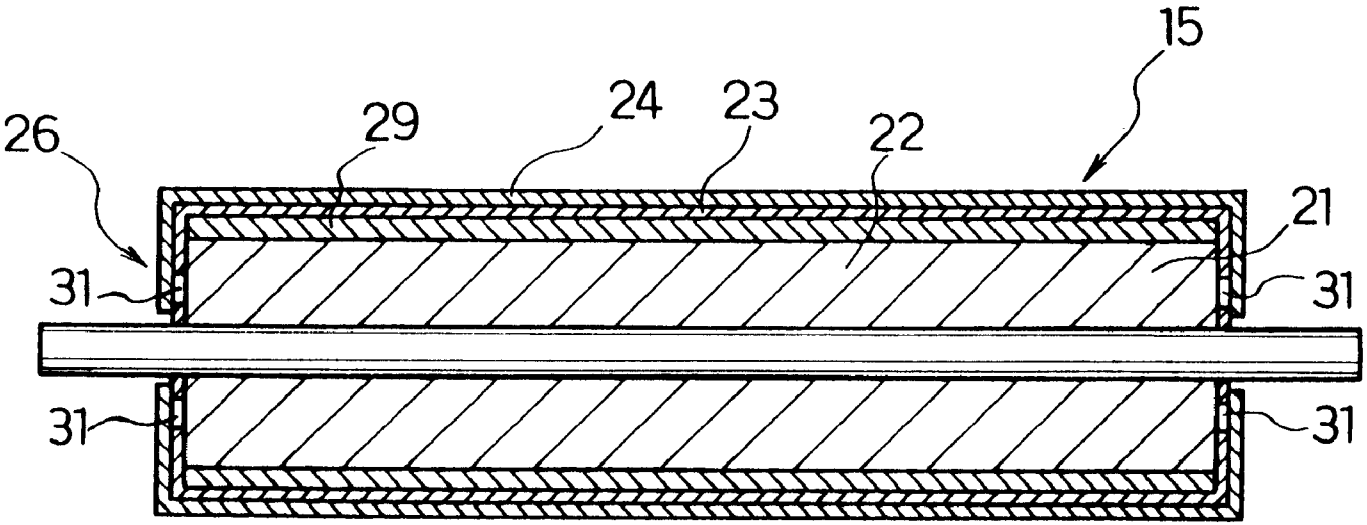
FIG. 9 is a sectional view showing an oil application roller in accordance with a fifth embodiment of the present invention.

FIG. 9 is a sectional view showing a fifth embodiment of the oil application roller of the present invention. A silicone rubber foam having a porosity of 87% and used as the oil holding layer 22 was cut in the shape of a cylinder measuring 6 mm in inner diameter and 17 mm in outer diameter.

Figure 14:
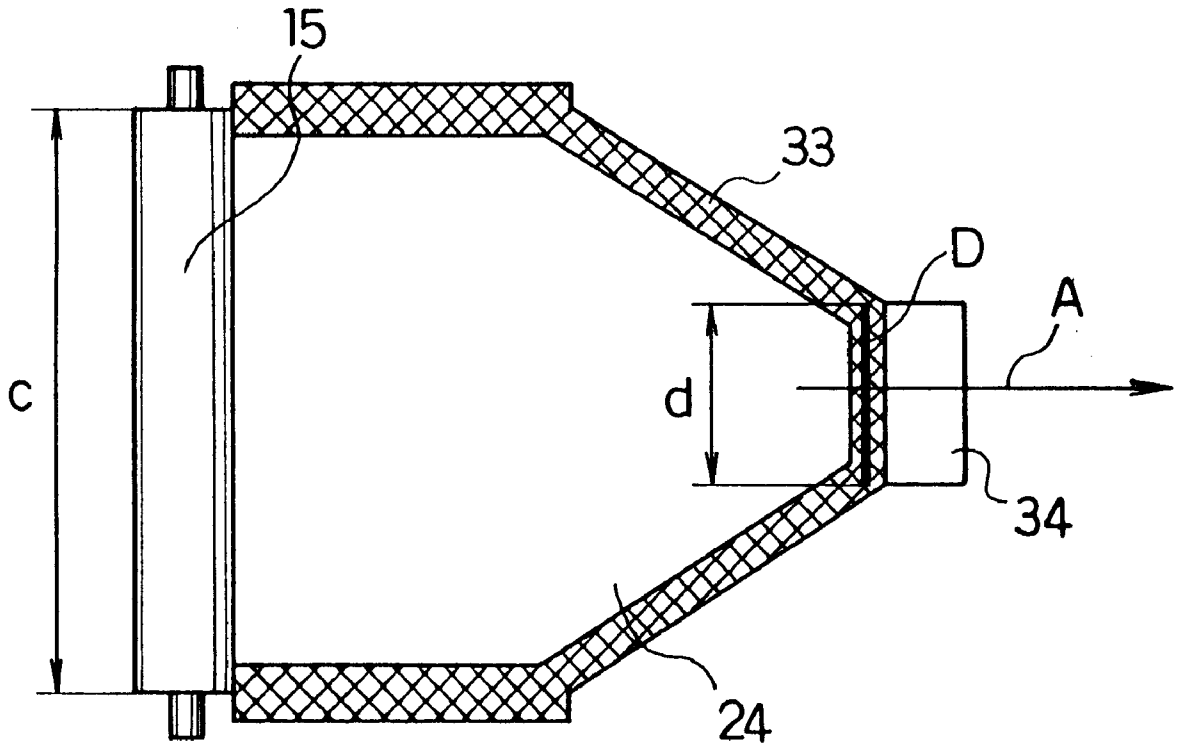
FIG. 14 is a plan view showing an oil leakage prevention film in accordance with the fifth and sixth embodiments of the present invention in a condition of being wound around the oil application roller.

The shaft 21 made of steel and having a diameter of 6 mm was inserted into the oil holding layer 22 and fused thereto. Furthermore, Nomex felt measuring 2 mm in thickness was cut in the shape of a tape measuring 30 mm in width. This tape was wound spirally around the oil holding layer 22 and bonded thereto by using a silicon-based adhesive to form the oil diffusion layer 29. Moreover, a drawn porous PTFE film (trade name Gore-Tex made by Japan Gore-Tex Inc.), a porous fibrous material, measuring 100 μm in thickness and provided with pores having a diameter of 0.2 μm on average and a porosity of 75% was wound around the surface of the layer 29 without applying any adhesive. In addition, this drawn porous film was then impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture was removed by scraping. The film was then heated at 150 deg. C. for 40 minutes to cause cross-linking, thereby forming a composite film used as the oil permeation control layer 23. Four vent holes 31 measuring 2 mm in diameter were provided 4 mm away from the circumferential surface of the shaft, at each of the end face 26 of the oil application roller 15. Next, the PET film 24 coated with the adhesive 33 (#8512US made by Sekisui Chemical Co., Ltd.) at the hatched portion as shown in FIG. 14 was closely wound around and bonded to the oil application roller 15 while being heated. Fluorosilicone oil (FS1265 made by Dow Corning Toray Silicone Co., Ltd.) was then injected into the silicone rubber foam 22 through the above-mentioned vent holes 31 shown in FIG. 9. The oil leakage prevention film 24 was bent and bonded to close the vent holes 31 in the side surfaces. The oil application roller was rotated so that oil was distributed uniformly by centrifugal force.

The adhesive 33 was applied as indicated by the hatched region in FIG. 14. The length d of the portion D of the region, wherein the adhesive was applied in a direction perpendicular to the pulling direction (indicated by the arrow), was ⅓ of the length c of the oil application roller. However, the length, d, can range from ⅔ or less of the axial length, c, of the oil application roller.

Although the oil application roller 15 produced as described above was placed in an upright condition during storage, no oil leakage was recognized even after one week. When the oil leakage prevention film 24 was removed from the oil application roller 15, the vent holes 31 were opened. As a result, the vent holes 31 did not remain closed by mistake during use.

Sixth Embodiment

Figure 10:
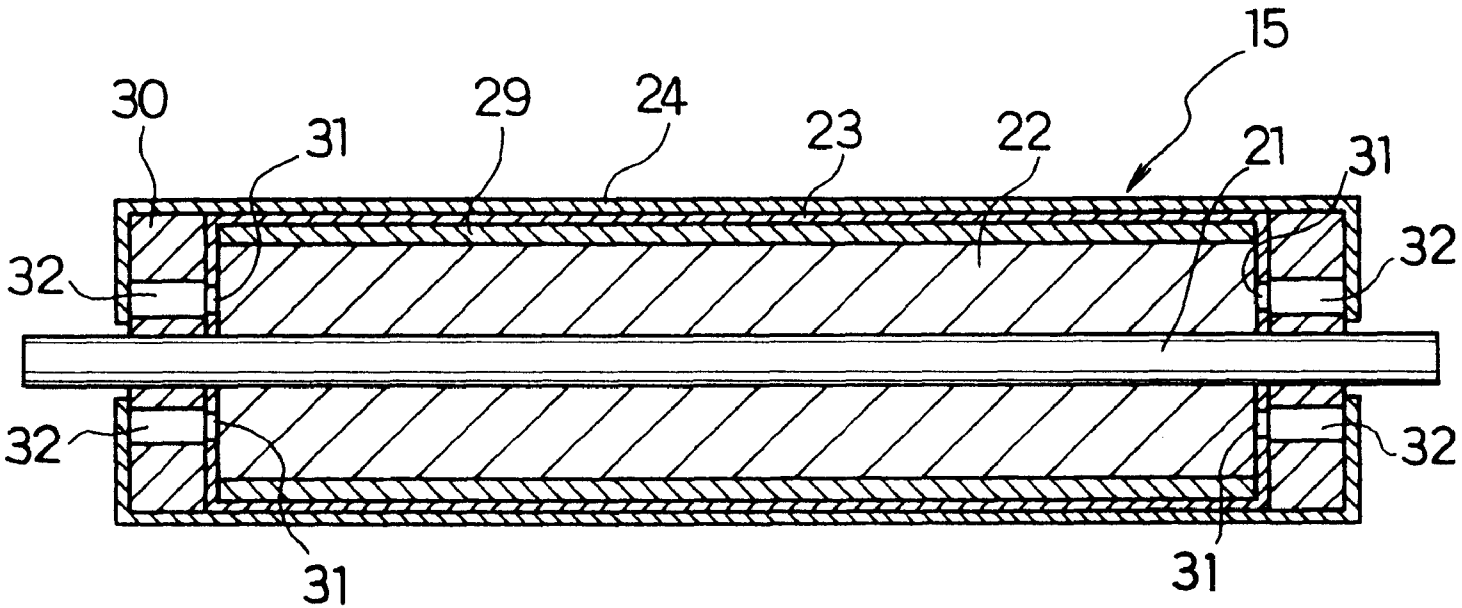
FIG. 10 is a sectional view showing an oil application roller in accordance with a sixth embodiment of the present invention.

FIG. 10 is a sectional view showing a sixth embodiment of the oil application roller of the present invention. The silicone rubber foam 22 having a porosity of 87% was cut in the shape of a cylinder measuring 6 mm in inner diameter and 17 mm in outer diameter. The shaft 21 made of steel and having a diameter of 6 mm was inserted into the foam 22 and fused thereto. Furthermore, Nomex felt measuring 2 mm in thickness was cut in the shape of a tape measuring 30 mm in width, and this tape was wound spirally around the foam 22 and bonded thereto by using a silicon-based adhesive to form the oil diffusion layer 29. Moreover, a drawn porous PTFE film (trade name Gore-Tex made by Japan Gore-Tex Inc.), a porous fibrous material, measuring 100 μm in thickness and provided with pores having a diameter of 0.2 μm on average and a porosity of 75% was wound around the surface of the layer 29 without applying any adhesive to obtain the oil permeation control layer 23. The film was wound so that its end portions were 3 mm away from the circumferential portions of the shaft, whereby the end portions of the oil permeation control layer 23 did not reach the circumferential portions of the shaft. A doughnut-shaped vent holes 31 was provided near each of the circumferential portions of the shaft. In addition, the drawn porous film was impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture was removed by scraping. The film was then heated at 150 deg. C. for 40 minutes to cause cross-linking, thereby forming a composite film used as the oil permeation control layer 23.

Fluorosilicone oil (FS1265 made by Dow Corning Toray Silicone Co., Ltd.) was then injected into the silicone rubber foam 22 through the above-mentioned vent holes 31. Seal rings made of polyether sulphone, each having four gas release holes 32 measuring 2 mm in diameter and communicating with the vent hole 31 at each side of the oil application roller 15, were inserted into the end portions of the roller. Next, the PET film 24 coated with the adhesive 33 (#8512US made by Sekisui Chemical Co., Ltd.) at the hatched portion as shown in FIG. 14 was closely wound around and bonded to the roller while being heated. At this time, the film was bonded to the seal rings 30 to close the gas release holes 32 in the side surfaces, thereby tightly sealing the oil application roller 15. Next, the oil application roller 15 was rotated so that oil was distributed uniformly by centrifugal force.

Although the oil application roller 15 produced as described above was placed in an upright condition during storage, no oil leakage was recognized even after one week. The oil leakage prevention film 24 was removed from the oil application roller 15 by pulling the tab 34 of the film. As a result, the oil leakage prevention film 24 was removed from the gas release holes 32. It was thus recognized that the vent holes for allowing steam to escape were opened.

Seventh Embodiment

Figure 11:
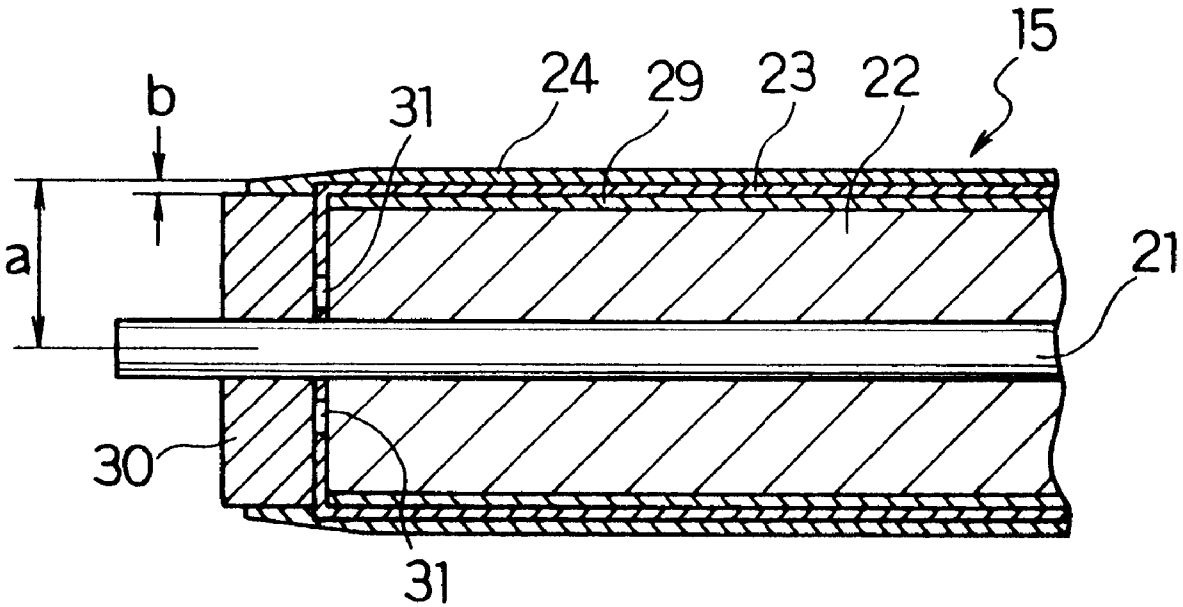
FIG. 11 is a sectional view showing an oil application roller in accordance with a seventh embodiment of the present invention.
Figure 15:
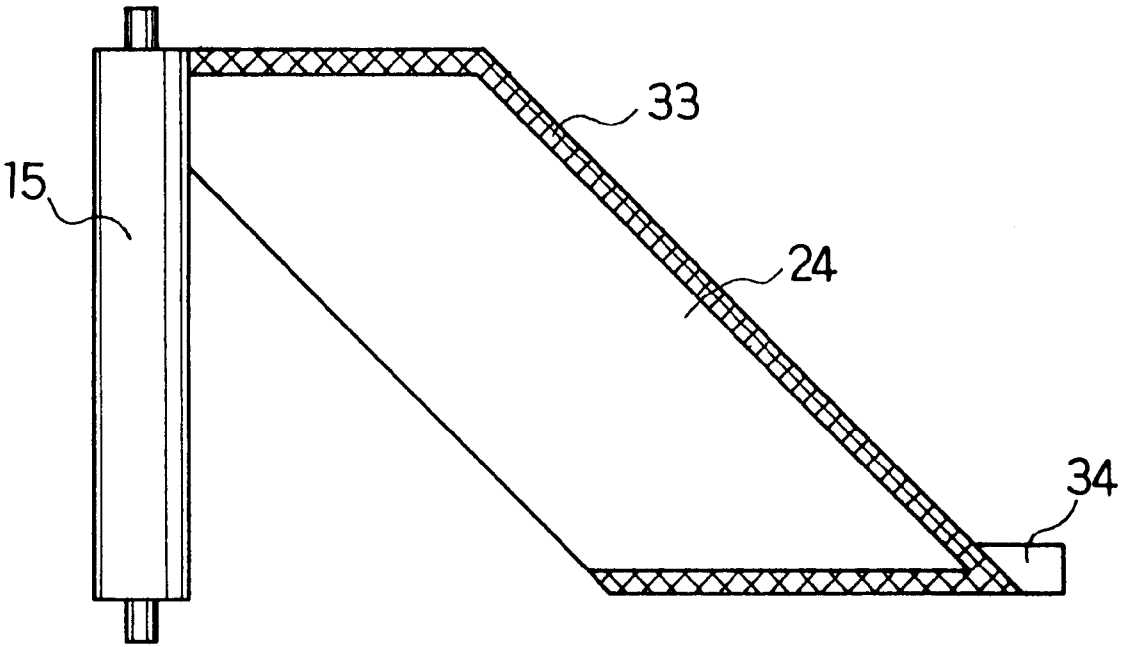
FIG. 15 is a plan view showing an oil leakage prevention film in accordance with the seventh embodiment of the present invention in a condition of being wound around the oil application roller.

FIG. 11 is a sectional view showing a seventh embodiment of the oil application roller of the present invention. A polyester-based polyurethane foam used as the oil holding layer 22 was cut in the shape of a cylinder measuring 6 mm in inner diameter and 17 mm in outer diameter. The shaft 21 made of steel and having a diameter of 6 mm was inserted into the oil holding layer 22 and fused thereto. Furthermore, Nomex felt measuring 2 mm in thickness was cut in the shape of a tape measuring 30 mm in width, and this tape was wound spirally around the oil holding layer 22 and bonded thereto by using a silicon-based adhesive to form the oil diffusion layer 29. Moreover, a silicone-based adhesive was applied in dots to the surface of a drawn porous PTFE film (trade name Gore-Tex made by Japan Gore-Tex Inc.), a porous fibrous material, measuring 100 μm in thickness and provided with pores having a diameter of 0.2 μm on average and a porosity of 75%. This film was wound around the surface of the layer 29 and bonded thereto. In addition, the drawn porous PTFE film was impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture was removed by scraping. The film was then heated at 150 deg. C. for 40 minutes to cause cross-linking, thereby forming a composite film used as the oil permeation control layer 23. Fluorosilicone oil (FS1265 made by Dow Corning Toray Silicone Co., Ltd.) was then injected at the end portions 26 of the above-mentioned polyurethane foam. The end portions were tightly sealed with seal rings 30 made of polyphenylene sulfide and measuring 9 mm in radius, 1 mm (corresponding to 0.1 a) smaller than the radius a (about 10 mm) of the oil application roller 15. Next, the PET film 24 coated with the adhesive 33 (#8512US made by Sekisui Chemical Co., Ltd.) at the hatched portion as shown in FIG. 15 was closely wound around and bonded to the oil application roller 15 while being heated. At this time, the end portions of the film were bonded to the seal rings 30 to tightly seal the oil application roller. At the end, the oil application roller was rotated so that oil was distributed uniformly by centrifugal force.

Although the oil application roller 15 produced as described above was placed in an upright condition during storage, no oil leakage was recognized even after one week. When the oil application roller 15 produced as described above was installed in the apparatus shown in FIG. 1 in a manner similar to the first embodiment and used, it was possible to maintain a constant biting amount. When oil was applied to 20,000 sheets of recording paper, the amount of oil applied was maintained stably.

Eighth Embodiment

Figure 16:
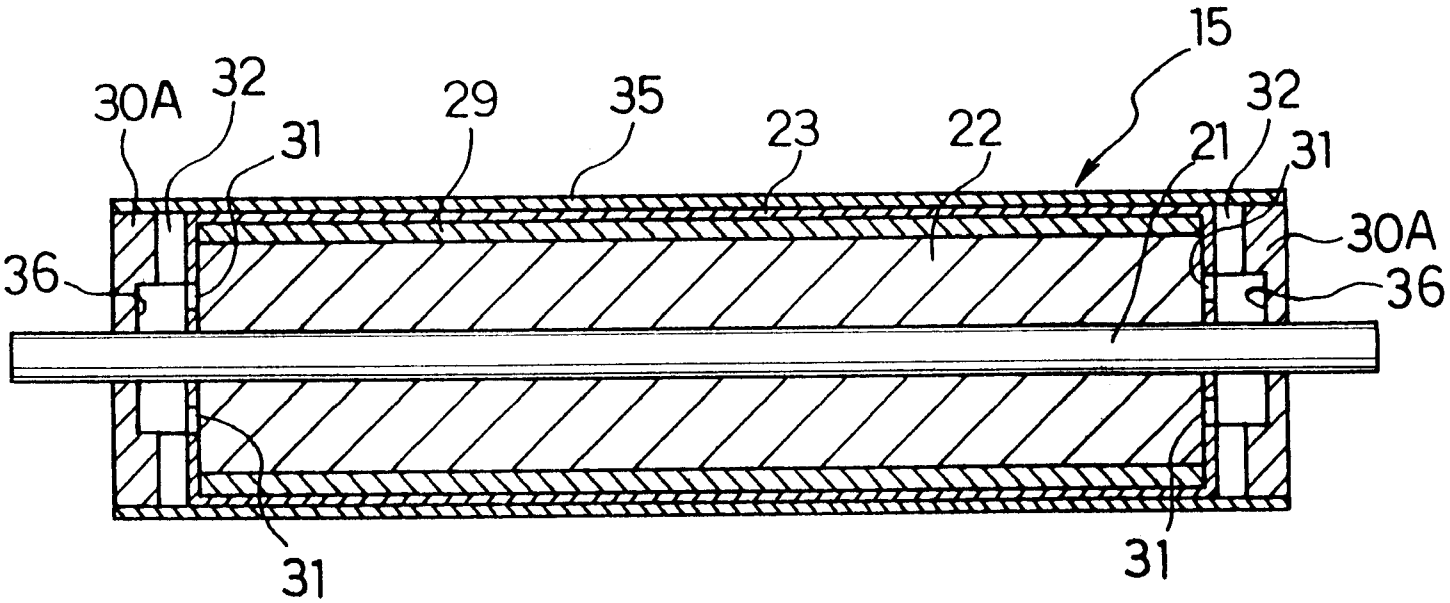
FIG. 16 is a sectional view showing an oil application roller in accordance with an eighth embodiment of the present invention.
Figure 17:
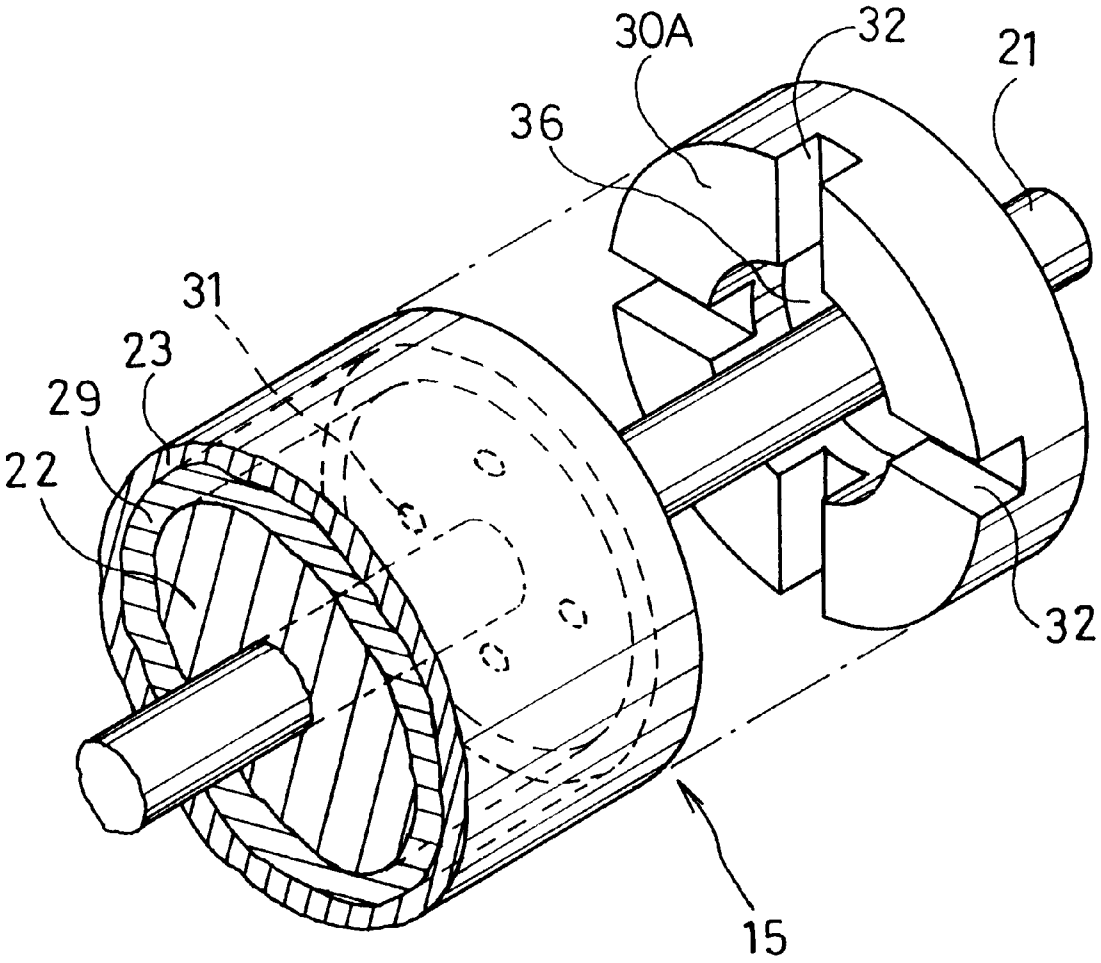
FIG. 17 is a perspective view showing an end portion of the oil application roller, including a seal ring, in accordance with the eighth embodiment of the present invention.

FIG. 16 is a sectional view showing an eighth embodiment of the oil application roller of the present invention. A polyester-based polyurethane foam used as the oil holding layer 22 was cut in the shape of a cylinder measuring 6 mm in inner diameter and 17 mm in outer diameter. The shaft 21 made of steel and having a diameter of 6 mm was inserted into the oil holding layer 22 and fused thereto. Furthermore, Nomex felt measuring 2 mm in thickness was cut in the shape of a tape measuring 30 mm in width, and this tape was wound spirally around the oil holding layer 22 and bonded thereto by using a silicon-based adhesive to form the oil diffusion layer 29. Moreover, a drawn porous PTFE film (trade name Gore-Tex made by Japan Gore-Tex Inc.), a porous fibrous material, measuring 100 $\mu$m in thickness and provided with pores having a diameter of 0.2 $\mu$m on average and a porosity of 75% was provided on the surface of the oil diffusion layer 29 and the end surfaces of the oil holding layer 22. At this time, first, a silicone-based adhesive was applied in dots to the surface of the drawn porous PTFE film, and this film was wound around the surface of the oil diffusion layer 29 and the end surfaces of the oil holding layer 22 and bonded thereto. Next, the drawn porous PTFE film was impregnated with a mixture including 80% of silicone rubber (KE106 made by Shin-Etsu Chemical Co., Ltd.) and 20% of silicone oil (KF96 made by Shin-Etsu Chemical Co., Ltd.). The excessive amount of the mixture was removed by scraping. The film was then heated at 150 deg. C. for 40 minutes to cause cross-linking, thereby forming a composite film used as the oil permeation control layer 23. Next, vent holes 31 are provided in the oil permeation control layer 23 on both side surfaces of the oil holding layer 29. Amino-denatured silicone oil (SF8417 made by Dow Corning Toray Silicone Co., Ltd.) was then injected at the end portions of the oil holding layer 22 of the above-mentioned polyurethane foam. As shown in the perspective figure of FIG. 17, both end portions were tightly sealed with seal rings 30A made of silicone rubber and having gas release holes 32 formed of radially-provided grooves. The seal ring 30A is provided with a recess portion 36 at the central portion of the seal ring 30A. A heat-shrinkable PET film 35 (S5642 made by Toyobo Co., Ltd.) was closely wound around the outer circumferential surfaces of the oil permeation control layer 23 and the seal rings 30A while being heated, whereby the end portions of the film were fused to the seal rings 30A by heat to tightly seal the oil application roller. In the end, the oil application roller 15 was rotated so that oil was distributed uniformly by centrifugal force.

Although the oil application roller 15 produced as described above was placed in an upright condition during storage, no oil leakage was recognized even after one week. When the heat-shrinkable oil leakage prevention film 35 was removed from the oil application roller 15, installed in the apparatus shown in FIG. 1 just as in the case of the first embodiment and used, the amount of oil applied was maintained stably.

The oil application roller 15 is sometimes removed temporarily from the apparatus at the time of maintenance of the apparatus. In the case of a conventional oil application roller, when the oil application roller 15 removed from the apparatus is placed in an upright condition during maintenance, a small amount of oil may leak from the vent holes 31 at the end portion of the roller. In the case of the oil application roller 15 of the present embodiment, however, oil leaked from the vent holes 31 in the above-mentioned upright condition accumulates at the recess portion 36 of the seal ring 30A, thereby causing no fear of spill of the leaking oil to the floor or the like. After the oil application roller 15 is installed in the apparatus, the small amount of oil accumulating in the recess portion 36 flows through the gas release holes 32 and is applied to the fixing roller (FIG. 1) without spilling outside.

Ninth Embodiment

Figure 18:
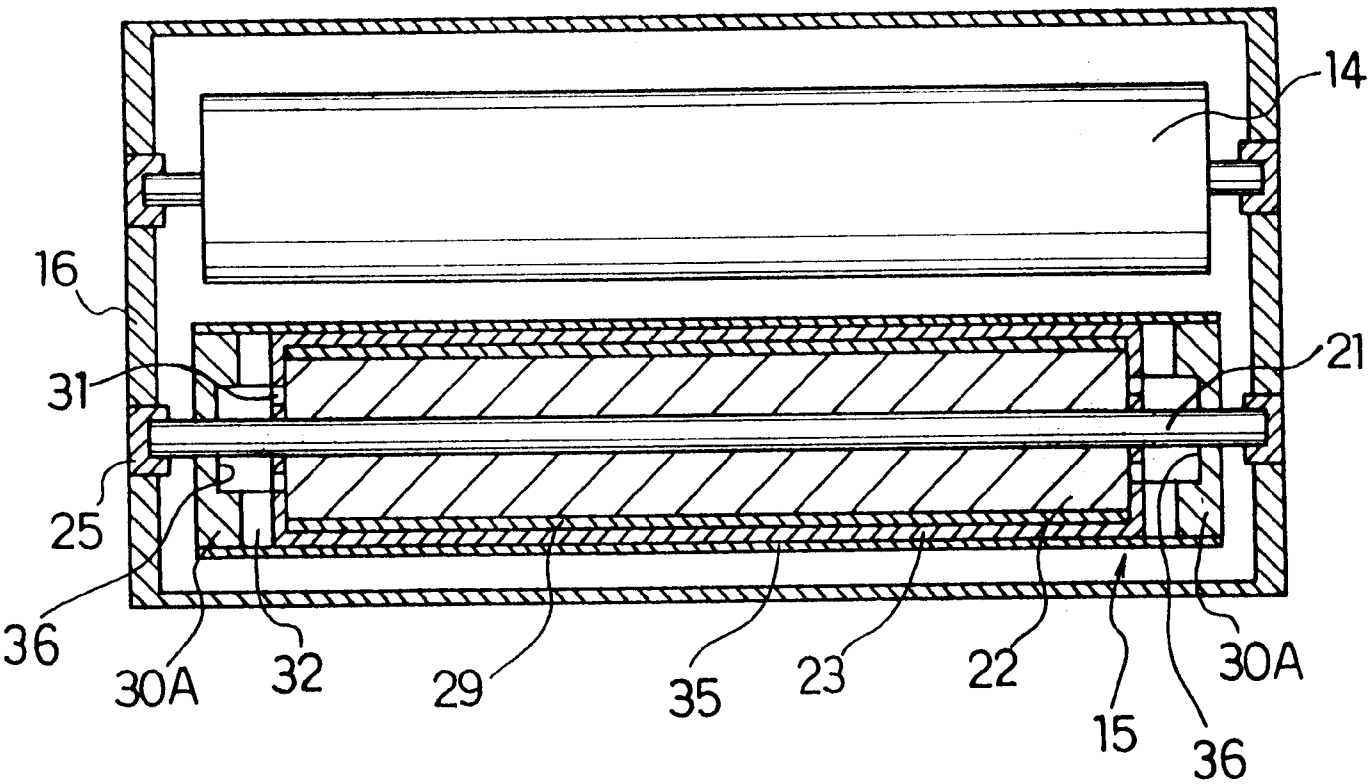
FIG. 18 is a sectional view showing an oil application roller unit in accordance with a ninth embodiment of the present invention.

FIG. 18 is a sectional view showing a ninth embodiment of the oil application roller unit of the present invention. The shaft 21 of the oil application roller 15 produced as described in the eighth embodiment was inserted into the bearings 25, and installed in the holder 16. The oil application roller unit having the configuration shown in FIG. 18 was obtained.

When the oil application roller unit produced as described above was installed in the apparatus shown in FIG. 1 in a manner similar to the first embodiment, it was possible to discharge steam pressure through the gas release holes 32. As a result, it was possible to attain stable oil application even after the fixing process was carried out 20,000 times.

We claim:

1. An oil application roller unit comprising an oil application roller rotatably supported by a holder, and an oil leakage prevention film closely wound around said oil application roller to pack said roller and capable of being pulled out, wherein said oil leakage prevention film is wound around said oil application roller so that, by pulling one end of said oil leakage prevention film in the state that said oil application roller is installed in said holder, said oil leakage prevention film can be removed while said oil application roller is rotated.

2. An oil application roller unit in accordance with claim 1, wherein an adhesive for securing said oil leakage prevention film is applied to a continuous range at least from one end portion to the other end portion of said oil application roller.

3. An oil application roller unit in accordance with claim 1, wherein the length of the application portion of an adhesive applied to said oil leakage prevention film in the direction perpendicular to a pulling direction of said oil leakage prevention film is ⅔ or less of the axial length of said oil application roller.

4. An oil application roller unit comprising an oil application roller having an oil application surface, seal rings provided to liquid-tightly seal both end portions of said oil application roller, and an oil leakage prevention film closely wound around said oil application roller to pack said roller and having end portions liquid-tightly secured to said seal rings.

5. An oil application roller unit in accordance with claim 4, wherein when the radius of said oil application roller is assumed to be "a", the radius of each said seal ring is in the range of 0.8a to 0.99a.

6. An oil application roller unit in accordance with claim 4, wherein the thermal expansion coefficient of each said seal ring is higher than that of a shaft of said roller.

7. An oil application roller unit in accordance with claim 4, wherein each said seal ring is made of an elastic material.

8. An oil application roller unit comprising an oil application roller rotatably supported by a holder, seal rings provided at both end portions of said oil application roller, and an oil leakage prevention film closely wound around said oil application roller to pack said roller, having end portions liquid-tightly secured to said seal rings, and capable of being pulled out, wherein said oil leakage prevention film is wound around said oil application roller so that, by pulling the end of said oil leakage prevention film in the state that said oil application roller is installed in said holder, said oil leakage prevention film can be removed while said oil application roller is rotated.

9. An oil application roller unit comprising an oil application roller having an oil application surface, and also having vent holes at end portions thereof, and an oil leakage prevention film closely wound around said oil application roller to pack said roller, wherein said vent holes are closed with end portions of said oil leakage prevention film.

10. An oil application roller unit comprising an oil application roller having an oil application surface, and also having vent holes at end portions thereof, an oil leakage prevention film closely wound around said oil application roller to pack said roller, and seal rings provided at both end portions of said oil application roller, and provided with gas release holes communicating with the interior of said oil application roller, wherein said gas release holes are closed with end portions of said oil leakage prevention film.

11. An oil application roller unit comprising an oil application roller rotatably supported by a holder, and having vent holes at end portions thereof, seal rings provided at both end portions of said oil application roller, and provided with gas release holes communicating with said vent holes of said oil application roller, on the substantially same surface as an oil application surface of said oil application roller, and a heat-shrinkable oil leakage prevention film closely wound around said oil application roller to pack said roller, wherein said gas release holes are closed with end portions of said heat-shrinkable oil leakage prevention film.

12. A fixing device having an oil application roller unit comprising fixing means for fixing toner to a recording medium under the action of heat and pressure, an oil application roller rotatably supported by a holder, and an oil leakage prevention film closely wound around said oil application roller to pack said roller and capable of being pulled out, wherein said oil leakage prevention film is wound around said oil application roller so that, by pulling one end of said oil leakage prevention film in the state that said oil application roller is installed in said holder, said oil leakage prevention film can be removed while said oil application roller is rotated.

13. A fixing device having an oil application roller unit comprising fixing means for fixing toner to a recording medium under the action of heat and pressure, an oil application roller having an oil application surface, seal rings provided to liquid-tightly seal both end portions of said oil application roller, and an oil leakage prevention film closely wound around said oil application roller to pack said roller and having end portions liquid-tightly secured to said seal rings.

14. A fixing device having an oil application roller unit comprising fixing means for fixing toner to a recording medium under the action of heat and pressure, an oil application roller rotatably supported by a holder, seal rings provided at both end portions of said oil application roller, and an oil leakage prevention film closely wound around said oil application roller to pack said roller, having end portions liquid-tightly secured to said seal rings, and capable of being pulled out, wherein said oil leakage prevention film is wound around said oil application roller so that, by pulling one end of said oil leakage prevention film in the state that said oil application roller is installed in said holder, said oil leakage prevention film can be removed while said oil application roller is rotated.

15. A fixing device having an oil application roller unit comprising fixing means for fixing toner to a recording medium under the action of heat and pressure, an oil application roller having at least vent holes at end portions thereof, and an oil leakage prevention film closely wound around said oil application roller to pack said roller, wherein said vent holes are closed with end portions of said oil leakage prevention film.

16. A fixing device having an oil application roller unit comprising fixing means for fixing toner to a recording medium under the action of heat and pressure, an oil application roller having vent holes at end portions thereof, an oil leakage prevention film closely wound around said oil application roller to pack said roller, and seal rings provided at both end portions of said oil application roller, and provided with gas release holes communicating with the interior of said oil application roller, wherein said gas release holes are closed with end portions of said oil leakage prevention film.

17. A fixing device having an oil application roller unit comprising fixing means for fixing toner to a recording medium under the action of heat and pressure, an oil application roller rotatably supported by a holder, and having vent holes at end portions thereof, seal rings provided at both end portions of said oil application roller, and provided with gas release holes communicating with said vent holes of said oil application roller, on the substantially same surface as an oil application surface of said oil application roller, and a heat-shrinkable oil leakage prevention film closely wound around said oil application roller to pack said roller, wherein said gas release holes are closed with end portions of said heat-shrinkable oil leakage prevention film.

18. An image formation apparatus having a photosensitive member rotated by rotation means, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller rotatably supported by a holder, and an oil leakage prevention film closely wound around said oil application roller to pack said roller, and capable of being pulled out, wherein said oil leakage prevention film is wound around said oil application roller so that, by pulling one end of said oil leakage prevention film in the state that said oil application roller is installed in said holder, said oil leakage prevention film can be removed while said oil application roller is rotated.

19. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller rotatably supported in the vicinity of said fixing means, seal rings provided at both end portions of said oil application roller, and an oil leakage prevention film closely wound around said oil application roller to pack said roller, and having end portions liquid-tightly secured to said seal rings.

20. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller rotatably supported by a holder, seal rings provided at both end portions of said oil application roller, and an oil leakage prevention film closely wound around said oil application roller to pack said roller, and having end portions tightly secured to said seal rings, wherein said oil leakage prevention film is provided with a pulling tab so that, by pulling said tab in the state that said oil application roller is installed in said holder, said oil leakage prevention film can be removed while said oil application roller is rotated.

21. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller having vent holes at end portions thereof, and an oil leakage prevention film closely wound around said oil application roller to pack said roller, wherein said vent holes are closed with end portions of said oil leakage prevention film.

22. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller, an oil leakage prevention film closely wound around said oil application roller to pack said roller, and seal rings provided at both end portions of said oil application roller, wherein said seal rings are provided with gas release holes communicating with the interior of said oil application roller, and said gas release holes are closed with end portions of said heat-shrinkable oil leakage prevention film.

23. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller rotatably supported by a holder, and having vent holes at end portions thereof, seal rings provided at both end portions of said oil application roller, and provided with gas release holes communicating with said vent holes, on the substantially same surface as an oil application surface of said oil application roller, and a heat-shrinkable oil leakage prevention film closely wound around said oil application roller to pack said roller, and to liquid-tightly cover said gas release holes with end portions thereof.

24. An oil application roller unit comprising an oil application roller having an oil holding portion for holding oil, and an oil application surface for applying said oil, seal members having vent holes communicating with said oil holding portion and open to said oil application surface, and an oil leakage prevention film for liquid-tightly sealing said oil application surface and said vent holes during storage of said oil application roller.

25. An oil application roller unit in accordance with claim 24, said seal members are provided at both end portions of said oil application roller, and provided with oil reservoirs to receive oil leaking from said oil holding portion at the time when the shaft of said oil application roller is held vertically.

26. An oil application roller unit comprising an oil application roller having at least a shaft and an oil application surface, and also having vent holes at end portions thereof, seal rings provided at both end portions of said oil application roller, and provided with gas release holes communicating with said vent holes, on the same surface as said oil application surface, and a heat-shrinkable oil leakage prevention film closely wound around said oil application roller to pack said roller, and to liquid-tightly cover said gas release holes of said seal rings with end portions thereof.

27. A fixing device comprising fixing means for fixing toner to a recording medium under the action of heat and pressure, an oil application roller having an oil application surface, and also having vent holes at end portions thereof, seal rings provided at both end portions of said oil application roller, and provided with gas release holes communicating with said vent holes, on the substantially same surface as said oil application surface of said oil application roller, and a heat-shrinkable oil leakage prevention film closely wound around said oil application roller to pack said roller, and to liquid-tightly cover said gas release holes of said seal rings with end portions thereof.

28. An image formation apparatus having a photosensitive member, a charger for charging said photosensitive member, an exposure device for forming an electrostatic latent image on said photosensitive member, a development device for developing said electrostatic latent image into a visible image, a transfer device for transferring a toner image on said photosensitive member to recording media, a cleaning device for removing toner remaining on said photosensitive member, and an oil application roller unit comprising fixing means for fixing a toner image to a recording medium under the action of heat and pressure, an oil application roller having an oil application surface, and also having vent holes at end portions thereof, seal rings provided at both end portions of said oil application roller, and provided with gas release holes communicating with said vent holes, on the substantially same surface as said oil application surface of said oil application roller, and a heat-shrinkable oil leakage prevention film closely wound around said oil application roller to pack said roller, and to liquid-tightly cover said gas release holes of said seal rings.

* * * * *